US011020972B2

(12) United States Patent
Hayashi

(10) Patent No.: US 11,020,972 B2
(45) Date of Patent: Jun. 1, 2021

(54) LIQUID DISCHARGE HEAD

(71) Applicant: BROTHER KOGYO KABUSHIKI KAISHA, Nagoya (JP)

(72) Inventor: Hideki Hayashi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 132 days.

(21) Appl. No.: 16/522,800

(22) Filed: Jul. 26, 2019

(65) Prior Publication Data

US 2020/0101739 A1 Apr. 2, 2020

(30) Foreign Application Priority Data

Sep. 28, 2018 (JP) ..... JP2018-183370

(51) Int. Cl.

| | |
|---|---|
| ***B41J 2/175*** | (2006.01) |
| ***B41J 2/155*** | (2006.01) |
| ***B41J 2/045*** | (2006.01) |
| *B41J 2/14* | (2006.01) |

(52) U.S. Cl.

CPC ..... *B41J 2/155* (2013.01); *B41J 2/04533* (2013.01); *B41J 2002/14467* (2013.01)

(58) Field of Classification Search

CPC ..... B41J 2/155; B41J 2/04533; B41J 2002/14467; B41J 2/161; B41J 2/1623; B41J 2/1626; B41J 2/1634; B41J 2002/14419; B41J 2002/14362; B41J 2002/14403; B41J 2/14233; B41J 2202/12; B41J 2202/20; B41J 2202/11; B41J 2002/14241; B41J 2/14467; B41J 2/14274; B41J 2002/14306; B41J 2/14145

See application file for complete search history.

(56) References Cited

U.S. PATENT DOCUMENTS

| | | | | |
|---|---|---|---|---|
| 2007/0195131 | A1* | 8/2007 | Katayama | B41J 2/14233 347/70 |
| 2010/0033537 | A1* | 2/2010 | Ito | B41J 2/14209 347/47 |
| 2020/0079081 | A1* | 3/2020 | Mizuno | B41J 2/14032 |

FOREIGN PATENT DOCUMENTS

| | | | |
|---|---|---|---|
| JP | 5327435 | B2 | 10/2013 |
| JP | 2017-39275 | A | 2/2017 |

* cited by examiner

*Primary Examiner* — Huan H Tran

(74) *Attorney, Agent, or Firm* — Merchant & Gould P.C.

(57) ABSTRACT

There is provided a liquid discharge head including: an individual channel member including individual channel rows; a first common channel member including first common channels and a first partitioning wall, and a damper joined to the first common channel member with adhesive. The damper has first portions that are elastically deformable and overlap with the first common channels and a second portion joined to the first partitioning wall and connected to the first portions. The second portion is thicker than the first portions.

17 Claims, 16 Drawing Sheets

LIQUID DISCHARGE HEAD

CROSS REFERENCE TO RELATED APPLICATION

The present application claims priority from Japanese Patent Application No. 2018-183370 filed on Sep. 28, 2018, the disclosure of which is incorporated herein by reference in its entirety.

BACKGROUND

Field of the Invention

The present disclosure relates to a liquid discharge head configured to discharge liquid from nozzles.

Description of the Related Art

As an exemplary liquid discharge head discharging liquid from nozzles, there is known an ink-jet head discharging ink from nozzles. The publicly known ink-jet head has the following features. Multiple pressure chambers communicating individually with the nozzles communicate with one manifold. Such a group of the pressure chambers and one manifold is provided in the ink-jet head, and multiple groups are typically provided in the ink-jet head. Ink channels are formed by stacking plates on top of each other. Recesses are formed at a lower portion of the plate joined to a lower surface of the plate provided with the manifold. The portion interposed between each recess and the manifold of the plate is elastically deformed, forming a damper inhibiting ink pressure fluctuation in manifolds. The plate provided with the nozzles is joined to the lower surface of the plate provided with the recesses to cover the recesses.

SUMMARY

In the liquid discharge head such as the above ink-jet head, some plates may be joined to each other with adhesive. In the case of joining the plates with adhesive, the adhesive may protrude from a joined surface where the plate having the recesses is joined to the plate having the nozzles and may invade the recesses. The adhesive invading the recesses may adhere to the dampers. If the adhesive adheres to only some of the dampers corresponding to manifold channels and/or if the amount of adhesive used for joining the plates varies, the dampers would have mutually different deformation amounts. In other words, the effect for inhibiting the pressure fluctuation in the manifolds varies.

An object of the present disclosure is to provide a liquid discharge head including plates joined to each other with adhesive and allowing multiple channels provided with a damper to have the uniformity of effect for inhibiting the pressure fluctuation brought about by the damper.

According to an aspect of the present disclosure, there is provided a liquid discharge head, including:

an individual channel member including a plurality of individual channel rows, each of the individual channel rows including a plurality of individual channels arranged in a first direction, the individual channels including a plurality of nozzles respectively, the individual channel rows being arranged in a second direction intersecting with the first direction, a first common channel member stacked on the individual channel member in a third direction intersecting with the first direction and the second direction, the first common channel member including:

a plurality of first common channels provided for each of the individual channel rows, connected to the individual channels forming one of the individual channel rows corresponding thereto, and arranged in the second direction, and a first partitioning wall partitioning the first common channels adjacent to each other in the second direction, and a damper joined to the first common channel member with adhesive so that the first common channel member is disposed between the individual channel member and the damper in the third direction, wherein the damper has a plurality of first portions that are elastically deformable and overlap in the third direction with the first common channels and a second portion that is joined to the first partitioning wall, extends in the second direction to positions overlapping in the third direction with the first common channels, and is connected to the first portions, and the second portion is longer in the third direction than the first portions.

In the liquid discharge head of the present disclosure, the first portions of the damper having a small thickness (the length in the third direction is short) are elastically deformable, which inhibits liquid pressure fluctuation in the first common channels. Further, in the liquid discharge head of the present disclosure, the second portion having a large thickness (the length in the third direction is long) is joined to the first partitioning wall, extends to positions overlapping with the pressure chambers, and is connected to the first portions. In that configuration, when the first common channel member is joined to the damper with adhesive, if the adhesive protrudes from the joining surface, the adhesive would adhere to the second portion and would not adhere to the first portions. The deformation of the first portions are thus not affected by the adhesive protruding from the joining surface, resulting in the uniformity of effect for inhibiting the pressure fluctuation in the first common channels.

DESCRIPTION OF THE EMBODIMENTS

An embodiment of the present disclosure is explained below.

<Configuration of Printer>

Figure 1:
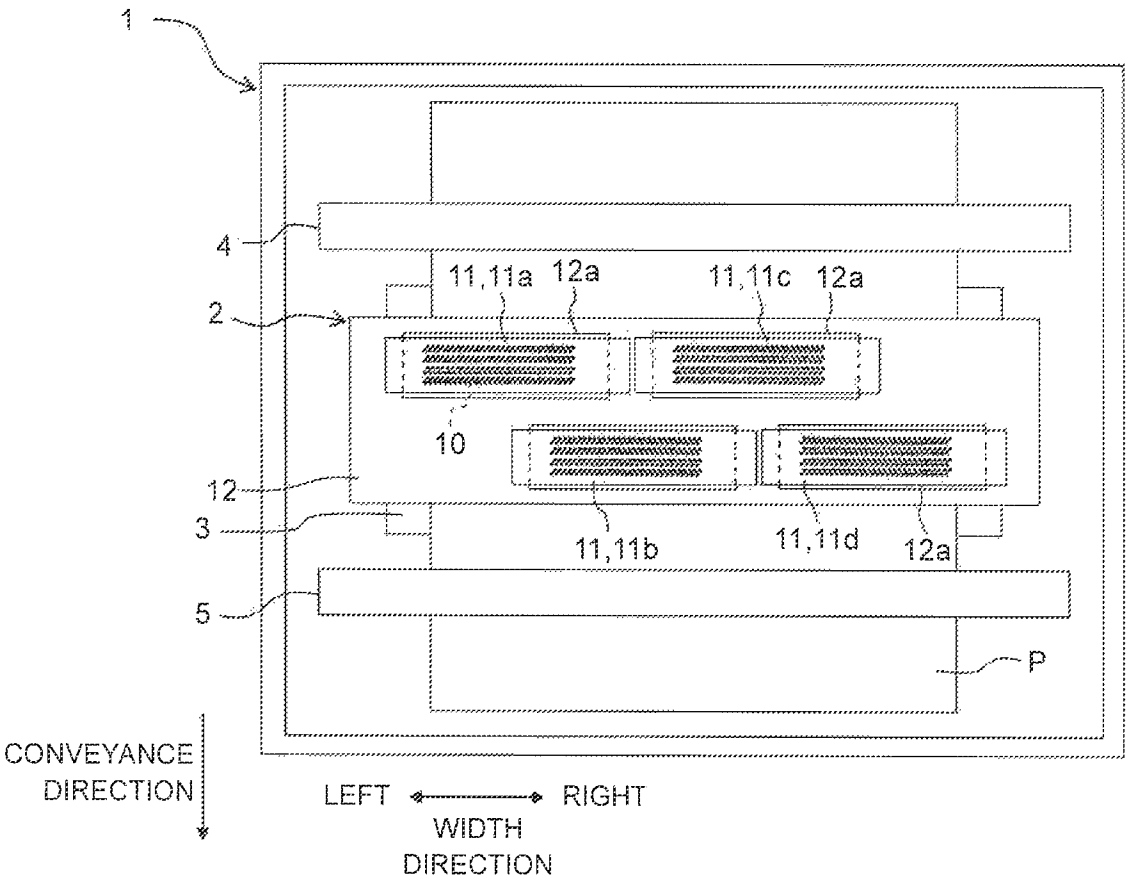
FIG. 1 schematically depicts a configuration of a printer.

As depicted in FIG. 1, a printer 1 according to this embodiment includes an ink-jet head 2, a platen 3, and conveyance rollers 4 and 5.

Figure 2:
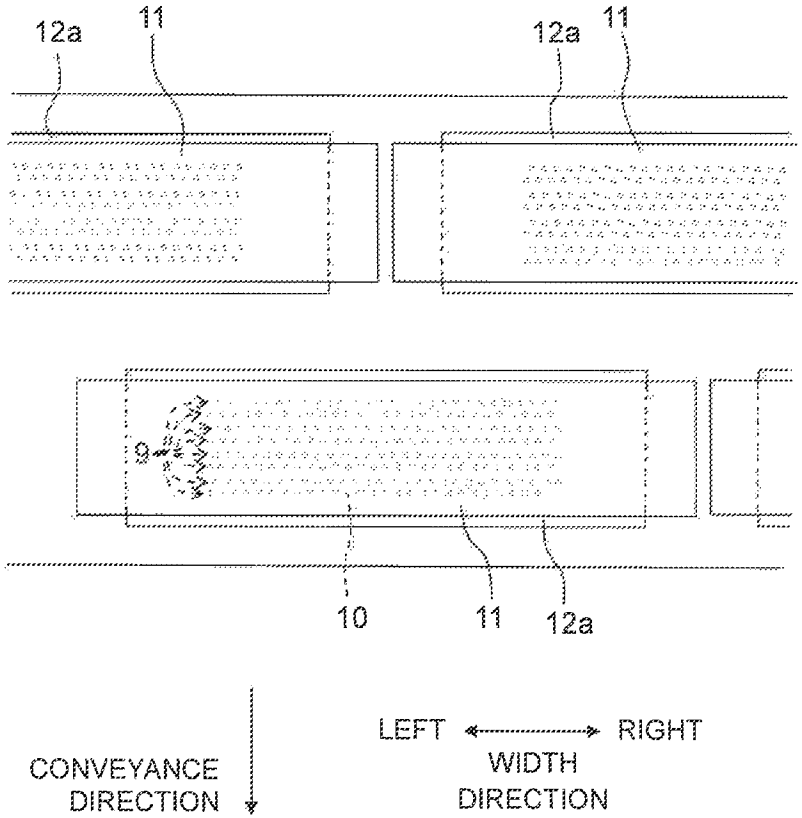
FIG. 2 is an enlarged view of parts of head units depicted in FIG. 1.
Figure 3:
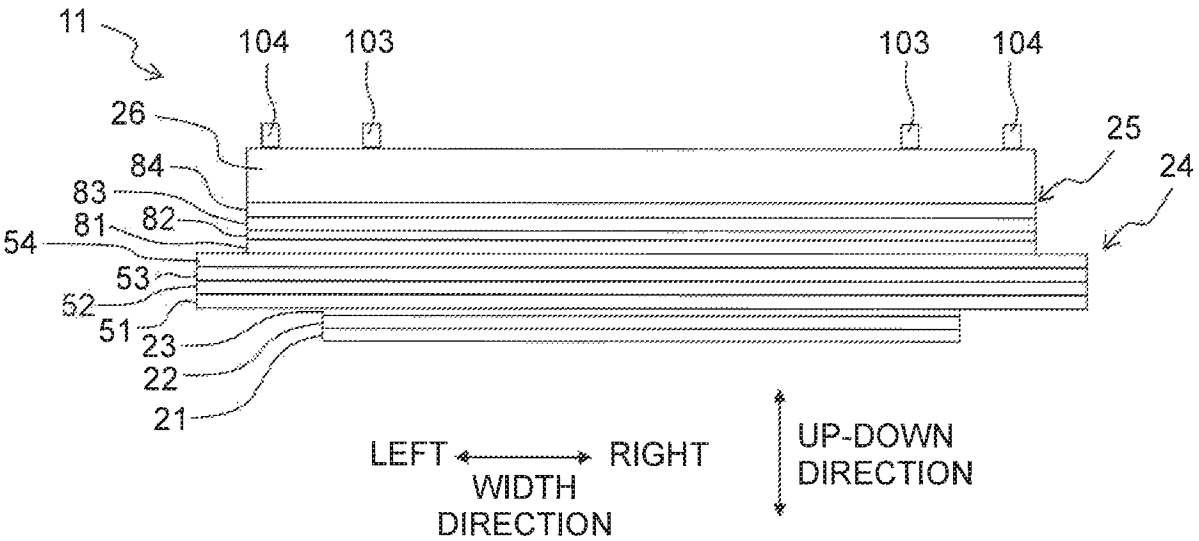
FIG. 3 depicts the head unit when seen from a downstream side in a conveyance direction.

As depicted in FIGS. 1 and 2, the ink-jet head 2 includes four head units 11*a* to 11*d* and a holding member 12. When the four head units 11*a* to 11*d* are not distinguished from each other, those head units are collectively referred to as head units 11. The head unit 11 corresponds to a liquid discharge head of the present disclosure. The head unit 11 discharges ink from nozzles 10, which are formed in a lower surface of the head unit 11. More specifically, the nozzles 10 are aligned in a sheet width direction (hereinafter simply referred to as a width direction, a first direction of the present disclosure) to form each nozzle row 9. The head unit 11 includes eight nozzle rows 9 arranged in a conveyance direction (a second direction of the present disclosure) orthogonal to the width direction. The width direction and the conveyance direction in this embodiment are defined as indicated in FIG. 1. Further, an up-down direction in this embodiment (a third direction of the present disclosure) is defined as indicated in FIG. 3.

Of the eight nozzle rows 9, nozzles 10 forming odd-numbered nozzle rows 9 from an upstream side in the conveyance direction are shifted in the width direction from nozzles 10 forming even-numbered nozzle rows 9 by a length that is half of pitches between nozzles 10. A black ink is discharged from nozzles 10 forming the first and second nozzle rows 9 from the upstream side in the conveyance direction. Similarly, a yellow ink is discharged from nozzles 10 forming the third and fourth nozzle rows 9 from the upstream side in the conveyance direction, a cyan ink is discharged from nozzles 10 forming the fifth and sixth nozzle rows 9 from the upstream side in the conveyance direction, and a magenta ink is discharged from nozzles 10 forming the seventh and eighth nozzle rows 9 from the upstream side in the conveyance direction. The following explanation is made by defining right and left sides in the width direction as indicated in FIG. 1. Further, in the following explanation, the n-th element from the upstream side in the conveyance direction is simply referred to as the n-th element.

The head unit 11*a* and the head unit 11*c* are arranged side by side in the width direction, and the head unit 11*b* and the head unit 11*d* are arranged side by side in the width direction. The head units 11*b* and 11*d* are positioned downstream of the head units 11*a* and 11*c* in the conveyance direction orthogonal to the width direction. The head units 11*b* and 11*d* are shifted right in the width direction from the head units 11*a* and 11*c*. Thus, in the ink-jet head 2, the nozzles 10 of the four head units 11 are aligned to extend over an entire length in the width direction of a recording sheet P. Namely, the ink-jet head 2 is a line head. Detailed configurations of the head unit 11 are described below.

The holding member 12 is a plate-like rectangular member that is long in the width direction. The four head units 11 are secured to the holding member 12. The holding member 12 has four rectangular through holes 12*a* that respectively correspond to the four head units 11. The nozzles 10 of the head units 11 are exposed to a lower side (recording sheet P side) through the respective through holes 12*a*.

The platen 3, which is disposed below the ink-jet head 2, faces the nozzles 10 of the four head units 11. The platen 3 supports the recording sheet P from below. The conveyance roller 4 is disposed upstream of the ink-jet head 2 and the platen 3 in the conveyance direction. The conveyance roller 5 is disposed downstream of the ink-jet head 2 and the platen 3 in the conveyance direction. The conveyance rollers 4 and 5 convey the recording sheet P in the conveyance direction.

The printer 1 performs recording on the recording sheet P by conveying the recording sheet P in the conveyance direction by use of the conveyance rollers 4 and 5 and discharging ink(s) from the nozzles 10 of the four head units 11.

<Head Unit>

Subsequently, the head units 11 are explained. As depicted in FIGS. 2 to 9, each head unit 11 includes an individual unit 21, a lower-side manifold plate 22 (a common channel member, a first common channel member of the present disclosure), a damper 23, a connection channel unit 24 (a damper chamber member of the present disclosure), an upper-side manifold unit 25 (a second supply channel member of the present disclosure), and a tube connection member 26.

Figure 4:
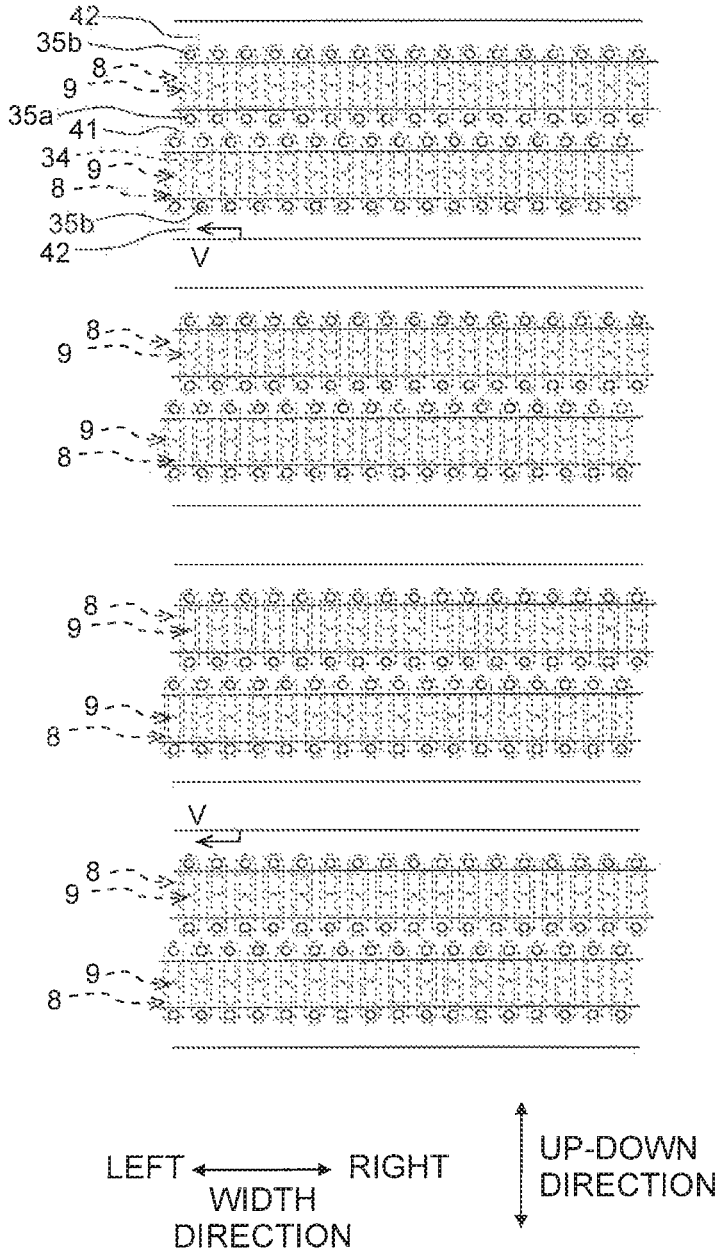
FIG. 4 is a plan view depicting parts of an individual unit and a lower-side manifold plate.
Figure 5:
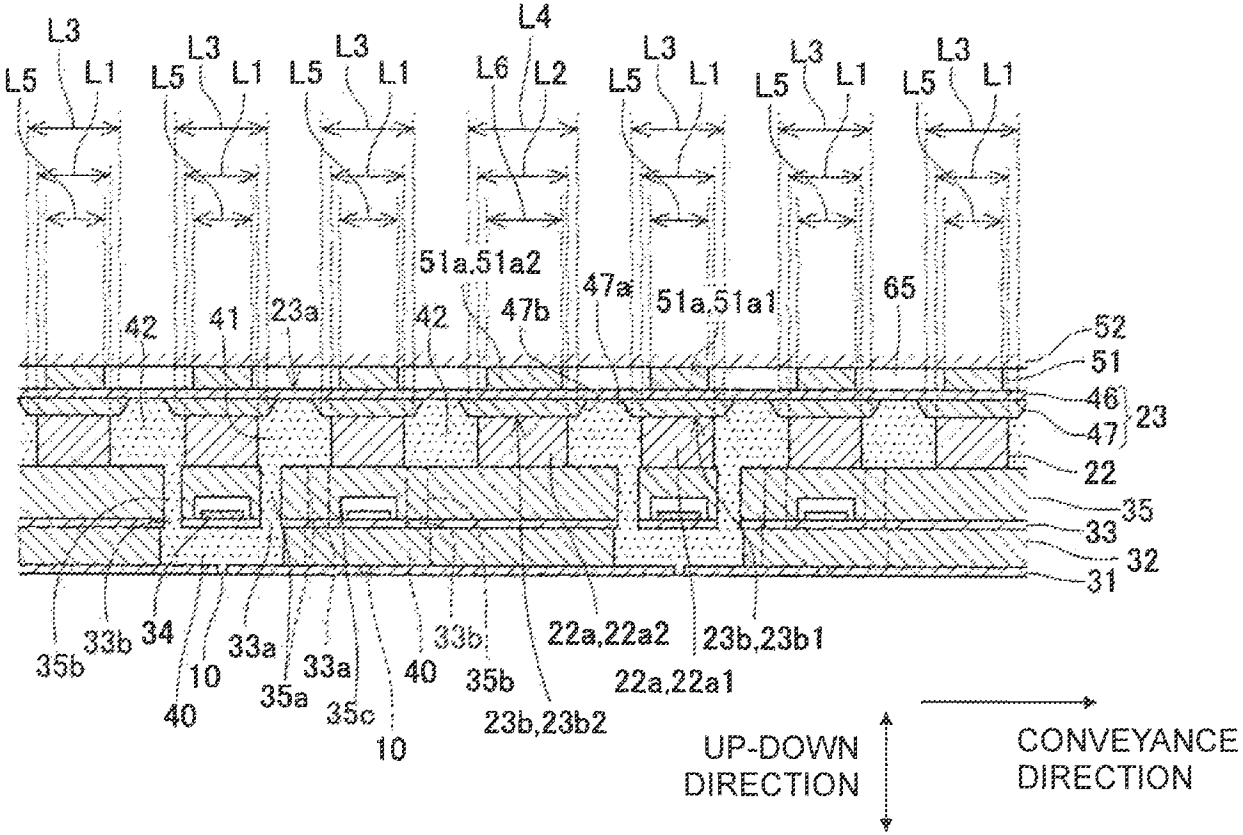
FIG. 5 is a cross-sectional view taken along a line V-V in FIG. 4.

As depicted in FIGS. 3 to 5, the individual unit 21 includes a nozzle plate 31, a channel substrate 32, a vibration film 33, driving elements 34, and a protection substrate 35. The nozzle plate 31 is made using, for example, a synthetic resin material. The nozzle plate 31 includes nozzles 10 forming the eight nozzle rows 9.

The channel substrate 32, which is made of silicon (Si), is disposed on an upper surface of the nozzle plate 31. The channel substrate 32 includes pressure chambers 40 corresponding to the nozzles 10, respectively. A center portion in the conveyance direction of each of the pressure chambers 40 overlaps in the up-down direction with the corresponding one of nozzles 10. The channel substrate 32 includes eight pressure chamber rows 8 formed by aligning pressure chambers 40 in the width direction. The eight pressure chamber rows 8 are arranged in the conveyance direction.

The vibration film 33, which is provided at an upper end of the channel substrate 32, covers the pressure chambers 40. The vibration film 33 is made using silicon dioxide (SiO2) or silicon nitride (SiN). The vibration film 33 is formed by oxidizing or nitriding the upper end of the channel substrate 32.

The vibration film 33 has inflow holes 33*a* at portions that overlap in the up-down direction with downstream ends in the conveyance direction of the pressure chambers 40 forming the odd-numbered pressure chamber rows 8. Similarly, the vibration film 33 has inflow holes 33*a* at portions that overlap in the up-down direction with upstream ends in the conveyance direction of the pressure chambers 40 forming the even-numbered pressure chamber rows 8. Further, the vibration film 33 has outflow holes 33*b* at portions that overlap in the up-down direction with upstream ends in the conveyance direction of the pressure chambers 40 forming the odd-numbered pressure chamber rows 8. Similarly, the vibration film 33 has outflow holes 33*b* at portions that overlap in the up-down direction with downstream ends in the conveyance direction of the pressure chambers 40 forming the even-numbered pressure chamber rows 8.

The driving elements 34 are provided corresponding to the pressure chambers 40, respectively. The driving elements 34 are arranged on an upper surface of the vibration film 33 at portions that overlap in the up-down direction with the pressure chambers 40. The driving elements 34 are, for example, piezoelectric elements including piezoelectric bodies, electrodes, and the like. The configuration of the driving elements 34 is similar to that of conventional driving elements, and thus detailed explanation thereof is omitted here.

The protection substrate 35, which is made using silicon (Si), is disposed on an upper surface of the channel substrate 32 provided with the vibration film 33 and the driving elements 34. The protection substrate 35 includes, at portions that overlap in the up-down direction with the inflow holes 33*a*, supply throttle channels 35*a* that pass through the protection substrate 35 in the up-down direction. Further, the protection substrate 35 includes, at portions that overlap in the up-down direction with the outflow holes 33*b*, return throttle channels 35*b* that pass through the protection substrate 35 in the up-down direction. Further, recesses 35*c* are formed at portions of a lower portion of the protection substrate 35 that overlap in the up-down direction with the pressure chambers 40 forming each pressure chamber row 8. The driving elements 34 corresponding to each pressure chamber row 8 are accommodated in the recesses 35*c*.

In this embodiment, a channel formed by the nozzle 10, the pressure chamber 40, the supply throttle channel 35*a*, and the return throttle channel 35*b* corresponds to an individual channel of the present disclosure. A row (a row corresponding to each of the nozzle row 9 and the pressure chamber row 8) formed by arranging the individual channels in the width direction corresponds to an individual channel row of the present disclosure. A set or group of the nozzle plate 31, the channel substrate 32, and the protection substrate 35 including the individual channels corresponds to an individual channel member of the present disclosure.

As depicted in FIGS. 3 to 6A, the lower-side manifold plate 22 is disposed on an upper surface of the protection substrate 35. The lower-side manifold plate 22 includes four lower-side supply manifolds 41 and eight lower-side return manifolds 42.

Each lower-side supply manifold 41 extends in the width direction along the supply throttle channels 35*a* that correspond to two pressure chamber rows 8 through which an ink in the same color flows. Each lower-side return manifold 42 extends in the width direction along the return throttle channels 35*b* that correspond to each pressure chamber row 8. The lower-side return manifolds 42 are connected to the return throttle channels 35*b*. The lower-side return manifolds 42 extend beyond the lower-side supply manifolds 41 in the width direction.

Part of the lower-side manifold plate 22 between the lower-side supply manifold 41 and the lower-side return manifold 42 adjacent to each other in the conveyance direction and part of the lower-side manifold plate 22 between two lower-side return manifolds 42 adjacent to each other in the conveyance direction are partitioning walls 22*a* (a first partitioning wall of the present disclosure) that partition the manifolds 41 and 42. The partitioning wall 22*a* between the lower-side return manifold 42 positioned at the downstream side that is included in two lower-side return manifolds 42 that correspond to the second pressure chamber row 8 and the lower-side return manifold 42 positioned at the upstream side that is included in two lower-side return manifolds 42 that correspond to the third pressure chamber row 8 is referred to as a partitioning wall 22*a*2 (a fourth partitioning wall of the present disclosure). Any other partitioning wall 22*a* than the partitioning wall 22*a*2 is referred to as a partitioning wall 22*a*1 (a third partitioning wall of the present disclosure). A length L2 of the partitioning wall 22*a*2 is longer than a length L1 of the partitioning wall 22*a*1.

Figure 6A:
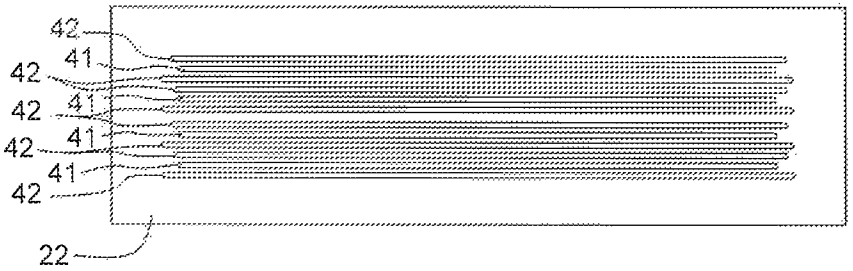
FIG. 6A is a plan view of the lower-side manifold plate.
Figure 6B:
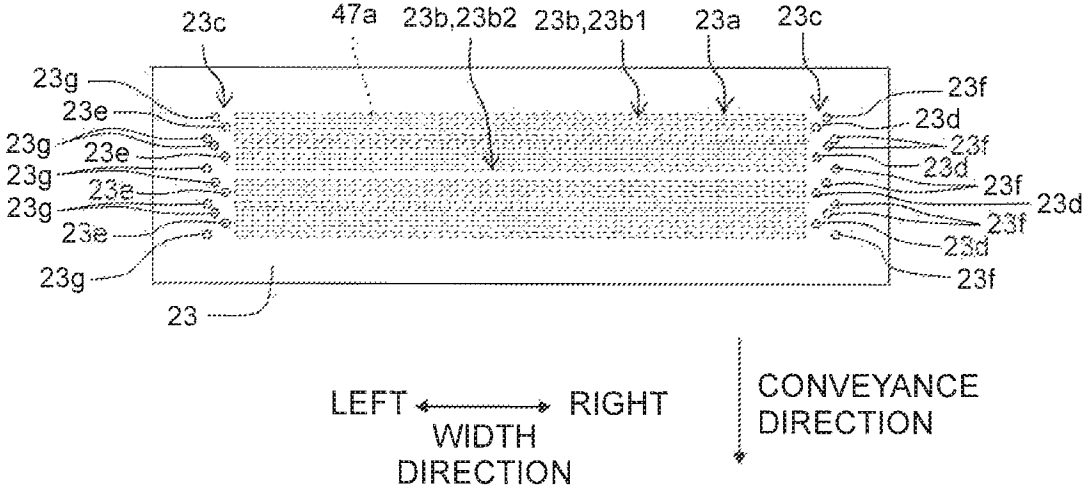
FIG. 6B is a plan view of a damper.

As depicted in FIGS. 3, 5, and 6B, the damper 23 is disposed on an upper surface of the lower-side manifold plate 22 to cover the four lower-side supply manifolds 41 and the eight lower-side return manifolds 42. The damper 23 includes a first damper member 46 and a second damper member 47.

The first damper member 46 is made using, for example, a synthetic resin material such as polyamide imide, polyimide (PI), polyethylene terephthalate (PET), polyphenylene sulfide (PPS), and polyethylene naphthalate (PEN). The first damper member 46 is a thin-film member of which length in the up-down direction is not more than 10 μm. The second damper member 47 is made using, for example, a metal material, such as stainless steel. The second damper member 47 is a member of which length in the up-down direction is approximately 150 μm. The second damper member 47 is disposed on the lower side of the first damper member 46. The second damper member 47 is joined to the upper surface of the lower-side manifold plate 22 with adhesive.

The second damper member 47 has through holes 47*a* at portions overlapping in the up-down direction with portions of the manifolds 41 and 42 not including both ends thereof in the conveyance direction. The length in the conveyance direction of the through hole 47*a* is shorter toward the upper side (toward the first damper member 46). In that case, each inner wall surface of the through hole 47*a* is an inclined surface 47*b* that is inclined to the up-down direction so that the upper side of the inclined surface 47*b* is closer to a center portion in the conveyance direction of the through hole 47*a* than the lower side. In other words, a diameter of the through hole 47*a* at the upper side of the inclined surface 47*b* is smaller than a diameter of the through hole 47*a* at the lower side of the inclined surface 47*b*.

In the damper 23 having the above configuration, portions of the first damper member 46 exposed from the through holes 47*a* are elastically-deformable first portions 23*a*. When the first portions 23*a* are elastically deformed, ink pressure fluctuation in the manifolds 41 and 42 can be reduced. For example, the first portions 23*a* are elastically deformed to an extent of approximately 60 μm at the maximum. In order to make the first portions 23*a* elastically deformable through the ink pressure fluctuation, the first damper member 46 can be made using a material of which Young's modulus is in a range of 5.5 to 6.5 GPa, preferably approximately 6 GPa.

In any other potions than the first portions 23*a* of the damper 23, the first damper member 46 overlaps in the up-down direction with the second damper member 47 and the thickness of the portions other than the first portions 23*a* is larger than that of the first portions 23*a*. Portions of the damper 23, in which the first damper member 46 overlaps with the second damper member 47, positioned at both sides in the conveyance direction of the first portion 23*a* are second portions 23*b*. Each second portion 23*b* is joined to the partitioning wall 22*a* with adhesive, extends in the conveyance direction to positions overlapping in the up-down direction with the manifolds 41 and 42, and connected to the first portions 23*a*.

A portion of the second portion 23*b* joined to the partitioning wall 22*a*1 is referred to as a second portion 23*b*1 (a fourth portion of the present disclosure), and a portion of the second portion 23*b* joined to the partitioning wall 22*a*2 is referred to as a second portion 23*b*2 (a fifth portion of the present disclosure). Since the length L2 of the partitioning wall 22*a*2 is longer than the length L1 of the partitioning wall 22*a*1 in the conveyance direction, a length L4 (>L2) of the second portion 23*b*2 is longer than a length L3 (>L1) of the second portion 23*b*1. Further, since the second portion 23*b* is longer than the first portion 23*a* in the up-down direction, portions included in the second portion 23*b* and overlapping in the up-down direction with the manifolds 41 and 42 are hardly deformed by ink pressure fluctuation in the manifolds 41 and 42.

Each portion where the first damper member 46 and the second damper member 47 of the damper 23 overlap with each other have two portions that overlap in the up-down direction with both ends in the width direction of the manifolds 41 and 42. The two portions are third portions 23*c*. Supply connection holes 23*d* and 23*e* are formed at portions included in the third portions 23*c* and overlapping in the up-down direction with the left and right ends in the width direction of the lower-side supply manifold 41. Return connection holes 23*f* and 23*g* are formed at portions included in the third portions 23*c* and overlapping in the up-down direction with the right end and left ends in the width direction of the lower-side return manifold 42. In this embodiment, the supply connection holes 23*d*, 23*e* and the return connection holes 23*f*, 23*g* correspond to first connection channels of the present disclosure.

<Connection Channel Unit>

As depicted in FIGS. 3, 5, and 7, the connection channel unit 24 is configured by four rectangular channel plates 51 to 54 that are stacked on top of each other in the up-down direction. The four channel plates 51 to 54 are long in the width direction. The channel plates 51 to 54 are made, for example, using 42 alloy or stainless steel.

Figure 7A:
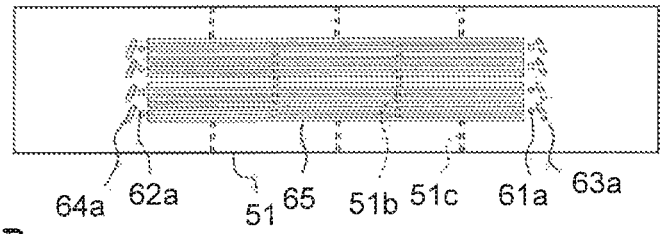
FIG. 7A is a plan view of the lowermost channel plate of a connection channel unit.

The channel plate 51 is disposed on an upper surface of the damper 23. As depicted in FIG. 7A, the channel plate 51 has four supply channel holes 61*a*, four supply channel holes 62*a*, four return channel holes 63*a*, and four return channel holes 64*a*. The supply channel holes 61*a*, 62*a* and the return channel holes 63*a*, 64*a* are through holes that pass through the channel plate 51 in the up-down direction.

The four supply channel holes 61*a* correspond to the four supply channel holes 23*d*. Each supply channel hole 61*a* overlaps in the up-down direction with the corresponding supply channel hole 23*d*. The four supply channel holes 62*a* correspond to the four supply channel holes 23*e*. Each supply channel hole 62*a* overlaps in the up-down direction with the corresponding supply channel hole 23*e*.

Each of the four return channel holes 63*a* corresponds to two return connection holes 23*f* through which an ink in the same color flows. Each return channel hole 63*a* extends across the corresponding two return connection holes 23*f* and is connected to the two return connection holes 23*f*. Each of the four return channel holes 64*a* corresponds to two return channel holes 23*g* through which an ink in the same color flows. Each return channel hole 64*a* extends across the corresponding two return channel holes 23*g* and is connected to the two return channel holes 23*g*.

Figure 8:
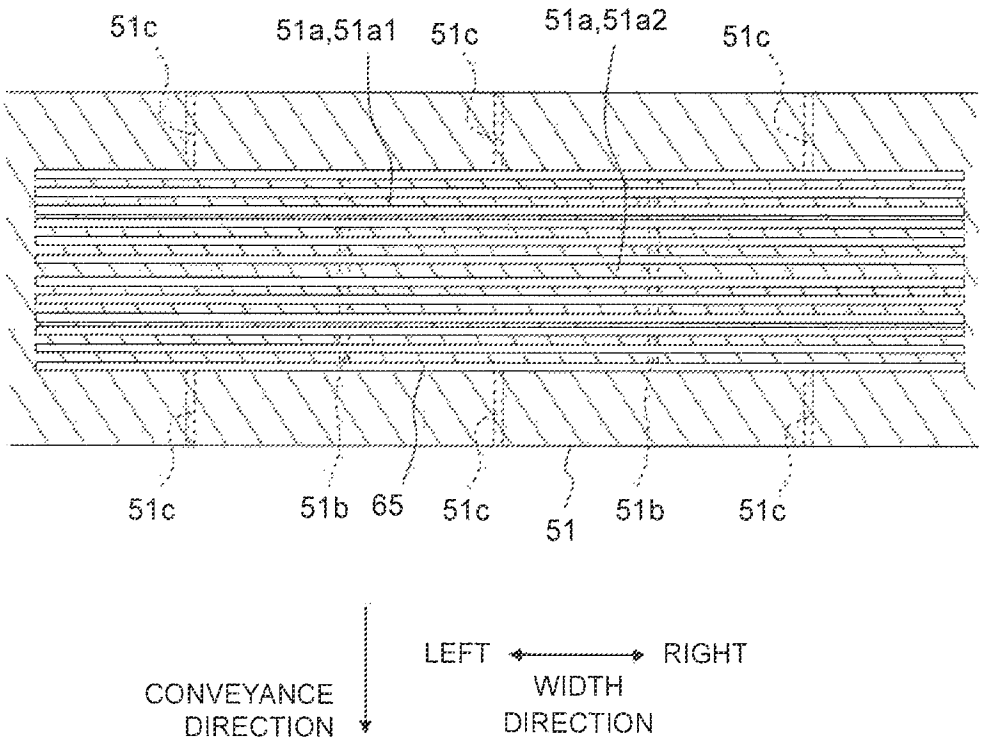
FIG. 8 is an enlarged view of part of FIG. 7A.

As depicted in FIGS. 5, 7A, and 8, the channel plate 51 includes, at portions overlapping in the up-down direction with the manifolds 41 and 42, first damper chambers 65 extending in the width direction. Each first damper chamber 65 is a space for receiving an upward deformation of the damper 23. In FIG. 8, potions not including the first damper chambers 65 are hatched to make FIG. 8 easily viewable.

The first damper chambers 65 are formed by through holes passing through the channel plate 51. A portion of the channel plate 51 between adjacent first damper chambers 65 is a partitioning wall 51*a* (a second partitioning wall of the present disclosure) that partitions the adjacent first damper chambers 65. In this embodiment, a length L5 in the conveyance direction of a partitioning wall 51*a*1 included in the partitioning wall 51*a* and overlapping in the up-down direction with the partitioning wall 22*a*1 is shorter than the length L1 of the partitioning wall 22*a*1. Further, a length L6 in the conveyance direction of a partitioning wall 51*a*2 included in the partitioning wall 51*a* and overlapping in the up-down direction with the partitioning wall 22*a*2 is shorter than the length L2 of the partitioning wall 22*a*2. The partitioning wall 51*a*1 is positioned between both ends in the conveyance direction of the partitioning wall 22*a*1, and the partitioning wall 51*a*2 is positioned between both ends in the conveyance direction of the partitioning wall 22*a*2.

The channel plate 51 includes two first communication channels 51*b* and six second communication channels 51*c*. Each first communication channel 51*b* extends over all the first damper chambers 65 in the conveyance direction to allow the first damper chambers 65 to communicate with each other. The two first communication channels 51*b* are arranged in the width direction at an interval.

Of the six second communication channels 51*c*, three second communication channels 51*c* are arranged at the upstream side in the conveyance direction to extend in the conveyance direction, and remaining three second communication channels 51*c* are arranged at the downstream side in the conveyance direction to extend in the conveyance direction. The first damper chamber 65 disposed at the most upstream side in the conveyance direction, the first damper chamber 65 disposed at the most downstream side in the conveyance direction, and end surfaces in the conveyance direction of the channel plate 51 are connected to each other through the upstream-side second communication channels 51*c* and the downstream-side second communication channels 51*c*. This allows the first damper chambers 65 disposed at the most upstream and most downstream sides in the conveyance direction to communicate with the atmosphere. As described above, the first damper chambers 65 communicate with each other through the first communication channels 51*b*. All the first damper chambers 65 thus communicate with the atmosphere by causing the first damper chambers 65 disposed at the most upstream and most downstream sides in the conveyance direction to communicate with the atmosphere through the second communication channels 51*c*.

The three second communication channels 51*c* disposed at the upstream side in the conveyance direction are arranged in the width direction at intervals, and the three second communication channels 51*c* disposed at the downstream side in the conveyance direction are arranged in the width direction at intervals. The positions in the width direction of the first communication channels 51*b* are different from those of the second communication channels 51*c*. The first communication channels 51*b* and the second communication channels 51*c* are formed by recesses in a lower surface of the channel plate 51.

Figure 7B:
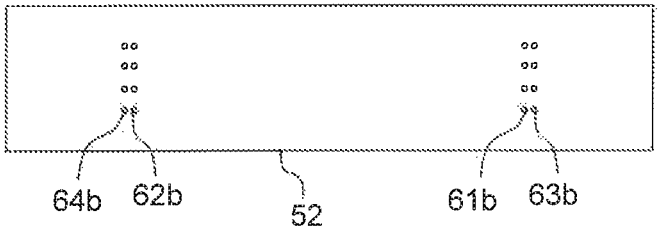
FIG. 7B is a plan view of the second lowermost channel plate of the connection channel unit.

The channel plate 52 is disposed on an upper surface of the channel plate 51. As depicted in FIG. 7B, the channel plate 52 has four supply channel holes 61*b*, four supply channel holes 62*b*, four return channel holes 63*b*, and four return channel holes 64*b*. The supply channel holes 61*b*, 62*b* and the return channel holes 63*b*, 64*b* are through holes that pass through the channel plate 52 in the up-down direction.

The four supply channel holes 61*b* correspond to the four supply channel holes 61*a*. Each of the supply channel holes 61*b* overlaps in the up-down direction with the corresponding one of the supply channel holes 61*a*. The four supply channel holes 62*b* correspond to the four supply channel holes 62*a*. Each of the supply channel holes 61*b* overlaps in the up-down direction with the corresponding one of the supply channel holes 61*a*. The four return channel holes 63*b* correspond to the four return channel holes 63*a*. Each of the return channel holes 63*b* overlaps in the up-down direction with a center portion of the corresponding one of the return channel holes 63*a*. The four return channel holes 64*b* correspond to the four return channel holes 64*a*. Each of the return channel holes 64*b* overlaps in the up-down direction with a center portion of the corresponding one of the return channel holes 64*a*.

Figure 7C:
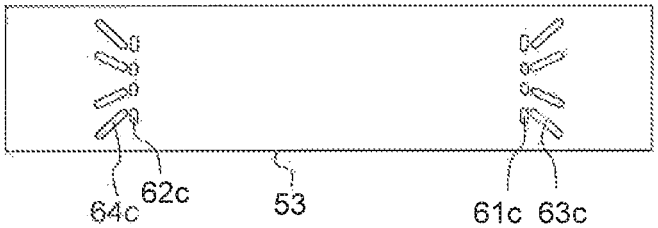
FIG. 7C is a plan view of the second uppermost channel plate of the connection channel unit.

The channel plate 53 is disposed on an upper surface of the channel plate 52. As depicted in FIG. 7C, the channel plate 53 has four supply channel holes 61*c*, four supply channel holes 62*c*, four return channel holes 63*c*, and four return channel holes 64*c*. The supply channel holes 61*c*, 62*c* and the return channel holes 63*c*, 64*c* are through holes that pass through the channel plate 53 in the up-down direction.

The four supply channel holes 61*c* correspond to the four supply channel holes 61*b*. Each of the supply channel holes 61*c* overlaps in the up-down direction with the corresponding one of the supply channel holes 61*b*. The first and second supply channel holes 61*c* extend from portions overlapping in the up-down direction with the supply channel holes 61*b* toward the upstream side in the conveyance direction. The third and fourth supply channel holes 61*c* extend from portions overlapping in the up-down direction with the supply channel holes 61*b* toward the downstream side in the conveyance direction.

The four supply channel holes 62*c* correspond to the four supply channel holes 62*b*. Each of the supply channel holes 62*c* overlaps in the up-down direction with the corresponding one of the supply channel holes 62*b*. The first and second supply channel holes 62*c* extend from portions overlapping in the up-down direction with the supply channel holes 62*b* toward the upstream side in the conveyance direction. The third and fourth supply channel holes 62*c* extend from portions overlapping in the up-down direction with the supply channel holes 62*b* toward the downstream side in the conveyance direction.

The four return channel holes 63*c* correspond to the four return channel holes 63*b*. Each of the return channel holes 63*c* overlaps in the up-down direction with the corresponding one of the return channel holes 63*b*. The first and second return channel holes 63*c* extend rightward from portions overlapping in the up-down direction with the return channel holes 63*b* such that inclination of the first and second return channel holes 63*c* to the width direction is greater toward the upstream side in the conveyance direction. The third and fourth return channel holes 63*c* extend rightward from portions overlapping in the up-down direction with the return channel holes 63*b* such that inclination of the third and fourth return channel holes 63*c* to the width direction is greater toward the downstream side in the conveyance direction.

The four return channel holes 64*c* correspond to the four return channel holes 64*b*. Each of the return channel holes 64*c* overlaps in the up-down direction with the corresponding one of the return channel holes 64*b*. The first and second return channel holes 64*c* extend leftward from portions overlapping in the up-down direction with the return channel holes 64*b* such that inclination of the first and second return channel holes 64*c* to the width direction is greater toward the upstream side in the conveyance direction. The third and fourth return channel holes 64*c* extend leftward from portions overlapping in the up-down direction with the return channel holes 64*b* such that inclination of the third and fourth return channel holes 64*c* to the width direction is greater toward the downstream side in the conveyance direction.

Figure 7D:
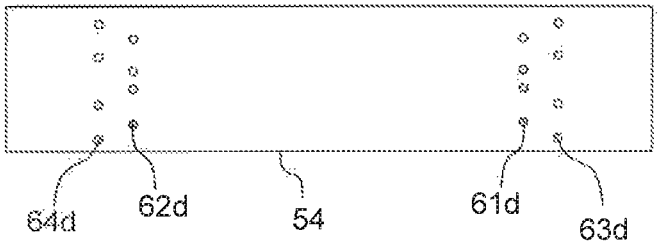
FIG. 7D is a plan view of the uppermost channel plate of the connection channel unit.
Figure 7D:
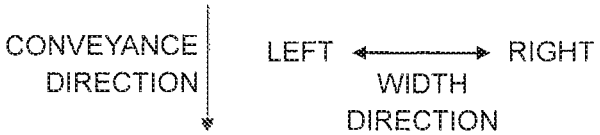

The channel plate 54 is disposed on an upper surface of the channel plate 53. As depicted in FIG. 7D, the channel plate 54 has four supply channel holes 61*d*, four supply channel holes 62*d*, four return channel holes 63*d*, and four return channel holes 64*d*. The supply channel holes 61*d* and 62*d* and the return channel holes 63*d* and 64*d* are through holes that pass through the channel plate 54 in the up-down direction.

The four supply channel holes 61*d* correspond to the four supply channel holes 61*c*. Each of the supply channel holes 61*d* overlaps in the up-down direction with an end of the corresponding one of the supply channel holes 61*c* that is opposite to the portion overlapping in the up-down direction with the supply channel hole 61*b*. The four supply channel holes 62*d* correspond to the four supply channel holes 62*c*. Each of the supply channel holes 62*d* overlaps in the up-down direction with an end of the corresponding one of the supply channel holes 62*c* that is opposite to the portion overlapping in the up-down direction with the supply channel hole 62*b*.

The four return channel holes 63*d* correspond to the four return channel holes 63*c*. Each of the return channel holes 63*d* overlaps in the up-down direction with an end of the corresponding one of the return channel holes 63*c* that is opposite to the portion overlapping in the up-down direction with the return channel hole 63*b*. The four return channel holes 64*d* correspond to the four return channel holes 64*c*. Each of the return channel holes 64*d* overlaps in the up-down direction with an end of the corresponding one of the return channel holes 64*c* that is opposite to the portion overlapping in the up-down direction with the return channel hole 64*b*.

<Upper-Side Manifold Unit 25>

The upper-side manifold unit 25 is disposed on an upper surface of the connection channel unit 24. As depicted in FIGS. 3 and 9, the upper-side manifold unit 25 includes a filter plate 82 and three channel plates 81, 83, and 84. The filter plate 82 and the channel plates 81, 83, and 84 are rectangular plates that are long in the width direction.

Figure 9A:
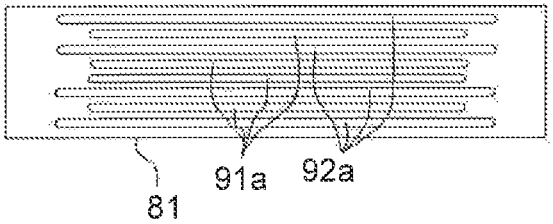
FIG. 9A is a plan view of the lowermost channel plate of an upper-side manifold unit.

As depicted in FIG. 9A, the channel plate 81 includes four supply manifold portions 91*a* and four return manifold portions 92*a*. The four supply manifold portions 91*a*, which extend in the width direction, are arranged in the conveyance direction at intervals. The four return manifold portions 92*a*, which extend in the width direction, are arranged in the conveyance direction at intervals. Each of the supply manifold portions 91*a* is arranged adjacently to the corresponding one of the return manifold portions 92*a* in the conveyance direction. More specifically, the first and second return manifold portions 92*a* are adjacent respectively to upstream portions in the conveyance direction of the first and second supply manifold portions 91*a*. The third and fourth return manifold portions 92*a* are adjacent respectively to downstream portions in the conveyance direction of the third and fourth supply manifold portions 91*a*.

Ends in the width direction of each supply manifold portion 91*a* overlap respectively with the supply channel holes 61*d* and 62*d* in the channel plate 54 of the connection channel unit 24. Ends in the width direction of each return manifold portion 92*a* overlap respectively with the return channel holes 63*d* and 64*d* in the channel plate 54 of the connection channel unit 24.

Figure 9B:
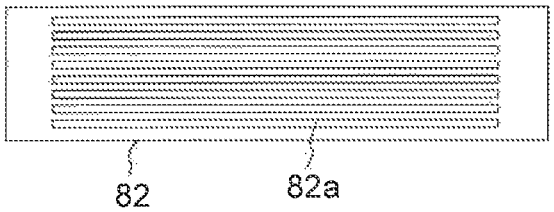
FIG. 9B is a plan view of a filter plate.

The filter plate 82 is disposed on an upper surface of the channel plate 81. As depicted in FIG. 9B, filters 82*a* are formed in the filter plate 82 at portions overlapping in the up-down direction with the supply manifolds 91*a* and at portions overlapping in the up-down direction with the return manifold portions 92*a*.

Figure 9C:
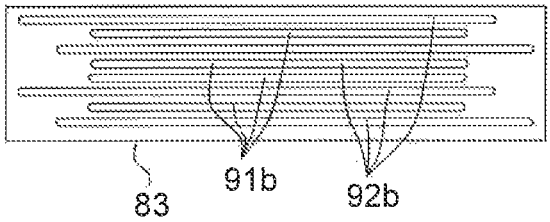
FIG. 9C is a plan view of the second uppermost channel plate of the upper-side manifold unit.

The channel plate 83 is disposed on an upper surface of the filter plate 82. As depicted in FIG. 9C, the channel plate 83 includes four supply manifold portions 91*b* and four return manifold portions 92*b*. The four supply manifold portions 91*b*, which extend in the width direction, overlap in the up-down direction with the four supply manifold portions 91*a*. The four return manifold portions 92*b*, which extend in the width direction, overlap in the up-down direction with the four return manifold portions 92*a*.

The first and third return manifold portions 92*b* extend leftward in the width direction beyond the first and third return manifold portions 92*a*. The second and fourth return manifold portions 92*b* extend rightward in the width direction beyond the second and fourth return manifold portions 92*a*. In that configuration, the positions of the ends in the width direction of the supply manifold portions 91*b* are different from the positions of the ends in the width direction of the return manifold portions 92*b*.

Figure 9D:
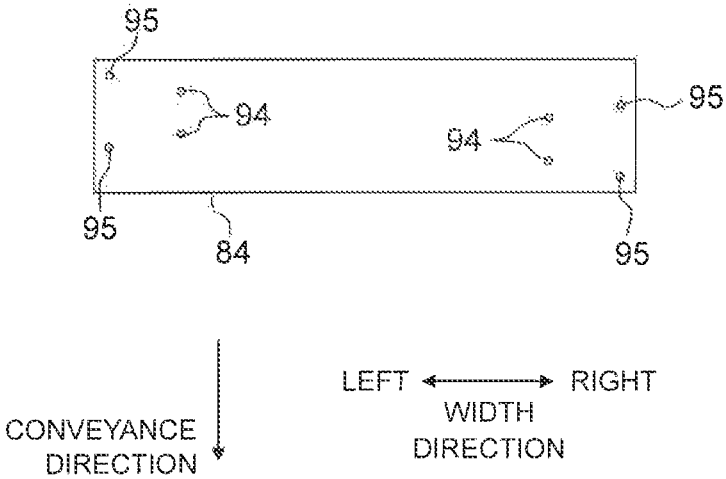
FIG. 9D is a plan view of the uppermost channel plate of the upper-side manifold unit.

The channel plate 84 is disposed on an upper surface of the channel plate 83. As depicted in FIG. 9D, the channel plate 84 has four supply holes 94 and four return holes 95. The four supply holes 94 correspond to the four supply manifold portions 91*b*. The supply holes 94 overlap in the up-down direction with left ends in the width direction of the first and third supply manifold portions 91*b* and right ends in the width direction of the second and fourth supply manifold portions 91*b*.

The four return holes 95 correspond to the four return manifold portions 92*b*. The return holes 95 overlap in the up-down direction with left ends in the width direction of the first and third return manifold portions 92*b* and right ends in the width direction of the second and fourth return manifold portions 92*b*.

In the upper-side manifold unit 25, the supply manifold portions 91*a* overlap in the up-down direction with the supply manifold portions 91*b* to form a manifold (hereinafter, referred to as an upper-side supply manifold 91). Further, the return manifold portions 92*a* overlap in the up-down direction with the return manifold portions 92*b* to form a manifold (hereinafter, referred to as an upper-side supply manifold 92). The filters 82*a* divide the upper-side supply manifold 91 into upper and lower portions. The filters 82*a* divide the upper-side return manifold 92 into upper and lower portions.

A channel formed by connecting the supply channel holes 61*a* to 61*d* is referred to as a supply connection channel 61. The supply channel hole 23*d* and the supply connection channel 61 connect a right end in the width direction of one lower-side supply manifold 41 and a right end in the width direction of one upper-side supply manifold 91. Further, a channel formed by connecting the supply channel holes 62*a* to 62*d* is referred to as a supply connection channel 62. The supply channel hole 23*e* and the supply connection channel 62 connect a left end in the width direction of one lower-side supply manifold 41 and a left end in the width direction of one upper-side supply manifold 91.

A channel formed by connecting the return channel holes 63*a* to 63*d* is referred to as a return connection channel 63. The return connection hole 23*f* and the return connection channel 63 connect right ends in the width direction of two lower-side return manifolds 42 and a right end in the width direction of one upper-side return manifold 92. Further, a channel formed by connecting the return channel holes 64*a* to 64*d* is referred to as a return connection channel 64. The return connection hole 23*g* and the return connection channel 64 connect left ends in the width direction of two lower-side return manifolds 42 and a left end in the width direction of one upper-side return manifold 92.

In this embodiment, the supply connection channel 63 and the return connection channel 64 correspond to second connection channels of the present disclosure.

<Tube Connection Member>

Figure 10:
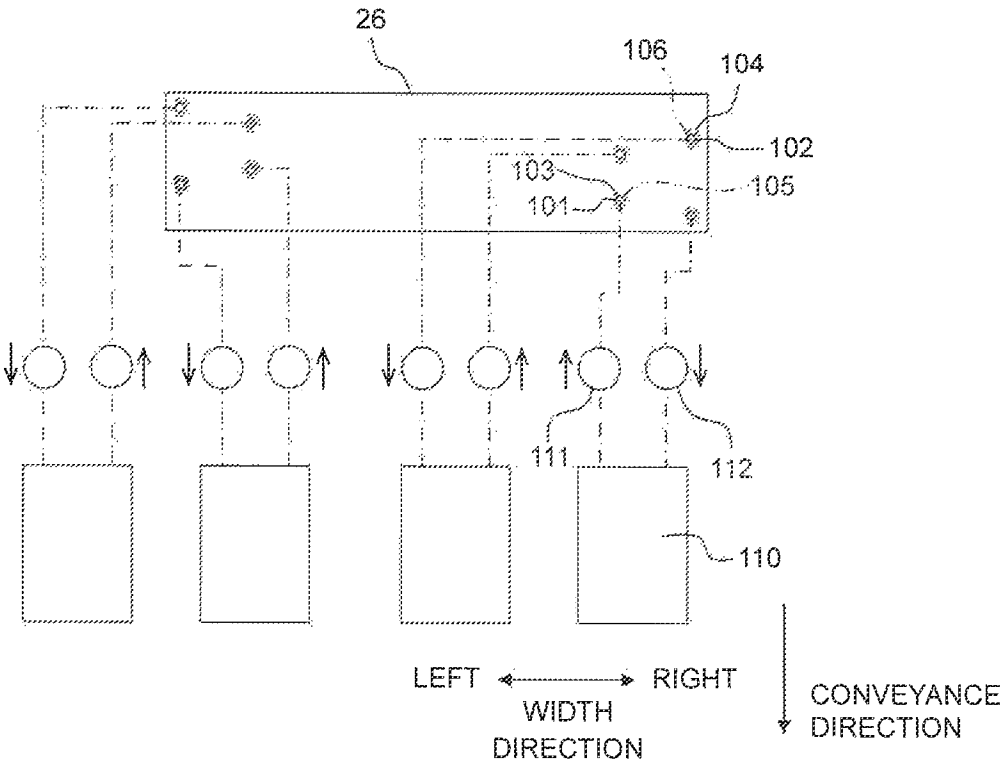
FIG. 10 is a plan view of a tube connection member.

As depicted in FIG. 3, the tube connection member 26, which is a block-like member having a rectangular parallelepiped shape, is made using a synthetic resin material and the like. The tube connection member 26 is disposed on an upper surface of the upper-side manifold unit 25. As depicted in FIG. 10, the tube connection member 26 includes four supply channels 101 and four return channels 102.

The four supply channels 101 correspond to the four supply holes 94 in the channel plate 84 of the upper-side manifold unit 25. Each of the supply channels 101 extends in the up-down direction and is connected to the corresponding one of the supply holes 94. The four return channels 102 correspond to the four return holes 95 in the channel plate 84. Each of the return channels 102 extends in the up-down direction and is connected to the corresponding one of the return holes 95.

The tube connection member 26 includes four supply tube connection portions 103 and four return tube connection portions 104. The four supply tube connection portions 103 protrude upward from an upper surface of the tube connection member 26. The four supply tube connection portions 103 correspond to the four supply channels 101. Each of the supply tube connection portions 103 is connected to the corresponding one of the supply channels 101.

Supply tubes 105 are connected to the respective supply tube connection portions 103. Each of the supply tube connection portions 103 is connected to an ink tank 110 storing the corresponding color of ink via the corresponding one of the supply tubes 105. A supply pump 111 is connected to part of the supply tube 105 between the supply tube connection portion 103 and the ink tank 110. The supply pump 111 pumps ink from the ink tank 110 to the supply tube connection portion 103.

The four return tube connection portions 104 protrude upward from the upper surface of the tube connection member 26. The four return tube connection portions 104 correspond to the four return channels 102. Each of the return tube connection portions 104 is connected to the corresponding one of the return channels 102.

The respective return tube connection portions 104 are connected to return tubes 106. Each of the return tube connection portions 104 is connected to an ink tank 110 storing the corresponding color of ink via the corresponding one of the return tubes 106. A return pump 112 is connected to part of the return tube 106 between the return tube connection portion 104 and the ink tank 110. The return pump 112 pumps ink from the return tube connection portion 104 to the ink tank 110.

When the supply pump 111 and the return pump 112 are driven, the ink in the ink tank 110 flows through the supply tube 105, the supply tube connection portion 103, the supply channel 101, the upper-side supply manifold 91, the supply connection channels 61 and 62, the lower-side supply manifold 41, and the supply throttle channel 35*a* in that order, and then flows into the pressure chamber 40 through the inflow hole 33*a*. The ink in the pressure chamber 40 outflows through the outflow hole 33*b*, flows through the return throttle channel 35*b*, the lower-side return manifold 42, the return connection channels 63 and 64, the upper-side return manifold 92, the return channel 102, the return tube connection portion 104, and the return tube 106 in that order, and returns to the ink tank 110. Namely, the ink circulates between the ink tank 110 and each head unit 11.

<Method for Manufacturing Head Unit>

Figure 11A:
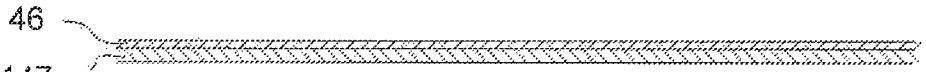
FIG. 11A illustrates a step of forming a first damper member on a second damper member.
Figure 11B:
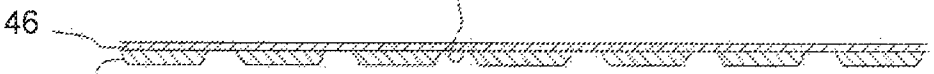
FIG. 11B illustrates a step of forming through holes in the second damper member.

Subsequently, a method for manufacturing the head unit 11 is explained. When the head unit 11 is manufactured, as depicted in FIG. 11A, the first damper member 46 is formed on a surface of a metal member 147 by a known film forming method. Then, as depicted in FIG. 11B, the metal member 147 is subjected to etching from a side opposite to the first damper member 46 to have through holes 47*a*, thus forming the metal member 147 as the second damper member 47. The inner wall surfaces of the through holes 47*a* are the inclined surfaces 47*b* described above. Here, the damper 23 is completed. Next, the damper 23 is joined to members that form the heat unit 11 and are prepared separately. The damper 23 is joined to the lower-side manifold plate 22 and the connection channel unit 24 (the channel plate 51) with adhesive. The synthetic resin material used for the first damper member 46 typically has no polarity. An upper surface of the first damper member 46 is thus made to have polarity through plasma processing, and the first damper member 46 is joined to the channel plate 51 with adhesive.

<Effects>

In this embodiment, the first portions 23*a* of the damper 23 having a small thickness (a short length in the up-down direction) are elastically deformed, thus inhibiting the ink pressure fluctuation in the manifolds 41 and 42. Portions included in the second portions 23*b*, which have a large thickness, and overlapping in the up-down direction with the manifolds 41 and 42 are hardly deformed owing to the pressure fluctuation in the manifolds 41 and 42.

Figure 11C:
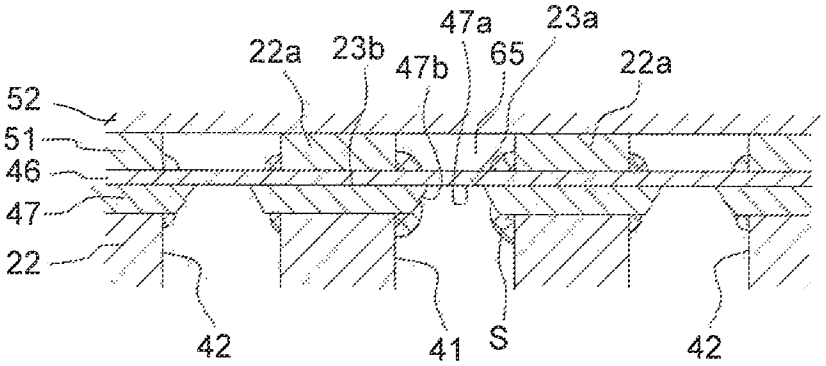
FIG. 11C illustrates a step of joining the damper to the lower-side manifold plate and the connection channel unit.

When the damper 23 is joined to the lower-side manifold plate 22 with adhesive, the adhesive may protrude from the joined surface. In this embodiment, however, the second portions 23*b* of the damper 23 are joined to the partitioning walls 22*a* so that they extend to the positions overlapping in the up-down direction with the manifolds 41 and 42. Thus, as depicted in FIG. 11C, although the adhesive S protruding from the joined surface adhere to the second portions 23*b*, it is not likely to reach the first portions 23*a*. The deformation of the first portions 23*a* is thus not likely to be affected by the adhesive, allowing the lower-side supply manifolds 41 and the lower-side return manifolds 42 to obtain the uniformity of effect for inhibiting the pressure fluctuation brought about by the damper 23.

In this embodiment, the inner wall surfaces of the through holes 47*a* of the second damper member 47 are the inclined surfaces 47*b*. Thus, even when the adhesive protruding from a portion between the damper 23 and the lower-side manifold plate 22 reaches an edge of the through hole 47*a*, the adhesive adheres to the inclined surface 47*b* of the through hole 47*a* and hardly reaches the first portion 23*a*.

When the damper 23 is joined to the connection channel unit 24 (the channel plate 51) with adhesive, the adhesive may protrude from the joined surface. Even in that case, although the adhesive adheres to the second portion 23*b*, it is not likely to reach the first portion 23*a*. This allows the lower-side supply manifolds 41 and the lower-side return manifolds 42 to obtain the uniformity of effect for inhibiting the pressure fluctuation brought about by the damper 23, similarly to the above.

In this embodiment, since the partitioning wall 51*a* is positioned between both ends in the conveyance direction of the partitioning wall 22*a*, a length of the second portion 23*b* ranging from an edge of an adhesion surface between the second portion 23*b* of the damper 23 and the channel plate 51 to a boundary between the first portion 23*a* and the second portion 23*b* is long. Thus, when the adhesive protrudes from the adhesion surface between the damper 23 and the channel plate 51, the adhesive protruding therefrom reliably fails to reach the first portion 23*a*.

In this embodiment, the damper 23 is formed by stacking the film-like first damper member 46 on the second damper member 47. Thus, for example, the damper 23 having the first portions 23*a* of which thickness is small is easily manufactured by forming the first damper member 46 having a small thickness on the second damper member 47 having a large thickness and then forming the through holes 47*a* in the second damper member 47 through etching. In this embodiment, the thickness (the length in the up-down direction) of the first damper member 46 is not more than 10 μm, which is very thin. It is thus difficult to manufacture the first damper member 46 independently. This embodiment, however, easily produces the damper 23 having the first damper member 46 and the second damper member 47, as described above.

In this embodiment, the supply channel holes 23*d* and 23*e* and the return connection holes 23*f* and 23*g* are formed in the third portions 23*c* of the damper 23. This makes it possible to form channels communicating with first common channels that are common to the manifolds 41 and 42 without making the head unit large.

In this embodiment, each first portion 23*a* is disposed between two third portions 23*c* arranged separately from each other in the width direction. This makes it possible to form the first portions for inhibiting the ink pressure fluctuation in the manifolds 41 and 42 and the channels communicating with the first common channels without making the head unit large.

In this embodiment, the number of the upper-side return manifolds 92 is smaller than the number of the lower-side return manifolds 42, making the structure of channels of the upper-side manifold unit 25 simple.

In this embodiment, the length L2 of the partitioning wall 22*a*2 is longer than the length L1 of the partitioning wall 22*a*1. Corresponding to this, the length L4 of the second portion 23*b*2 joined to the partitioning wall 22*a*2 is longer than the length L3 of the second portion 23*b*1 joined to the partitioning wall 22*a*1. This enhances the strength of the head unit 11.

In this embodiment, the first damper chambers 65 are arranged in the conveyance direction, the first communication channels 51*b* extending in the conveyance direction allow the first damper chambers 65 to communicate with each other, and the second communication channels 51*c* allow the first damper chambers 65 disposed at the most upstream side and the most downstream side in the conveyance direction to communicate with the atmosphere, thus allowing the first damper chambers 65 to communicate with the atmosphere.

In this embodiment, of the channel plates 51 to 54 forming the connection channel unit 24, the channel plate 51 has the through holes corresponding to the first communication channels 51*b* and the second communication channels 51*c*, and the channel plates 52 to 54 have no through holes and no recesses corresponding to the first communication channels 51*b* and the second communication channels 51*c*. In that configuration, when the channel plates 51 to 54 are joined to each other with adhesive, the adhesive protruding from the joined surface between the channel plate 51 and the channel plate 52 is likely to flow into the first communication channel(s) 51*b* and the second communication channel (s) 51*c*. On the other hand, the adhesive protruding from the adhesive surfaces between the channel plates 52 to 54 is not likely to flow into the first communication channel(s) 51*b* and the second communication channel(s) 51*c*. The amount of the adhesive flowing into the first communication channel (s) 51*b* and the second communication channel(s) 51*c* is thus reduced.

Unlike this embodiment, the first communication channels 51*b* and the second communication channels 51*c* may be arranged at the same position in the width direction. In that case, the strength of portions of the channel plate 51 where the first communication channels 51*b* and the second communication channels 51*c* are formed in the width direction is extremely small, thus damaging the channel plate 51 easily. In order to solve that problem, the first communication channels 51*b* and the second communication channels 51*c* have mutually different positions in the width direction. This hardly damages the channel plate 51.

<Modified Embodiments>

Although the embodiment of the present disclosure is explained above, the present disclosure is not limited to the above embodiment, and a variety of modifications are possible without departing from the claims.

In the above embodiment, the first communication channels 51*b* and the second communication channels 51*c* have mutually different positions in the width direction. The present disclosure, however, is not limited thereto. The first communication channels 51*b* and the second communication channels 51*c* may have the same position in the width direction.

In the above embodiment, the first communication channels 51*b* and the second communication channels 51*c* are formed by the recesses in the channel plate 51. The present disclosure, however, is not limited thereto. For example, the first communication channels 51*b* and the second communication channels 51*c* may be formed by through holes in the channel plate 51. In that configuration, the adhesive protruding from every joined surface between the channel plates 51 to 54 is not likely to flow into the first communication channel(s) 51*b* and the second communication channel(s) 51*c*. The amount of the adhesive flowing into the first communication channel(s) 51*b* and the second communication channel(s) 51*c* is thus reduced.

In the above embodiment and the first modified embodiment, only the channel plate 51 of the channel plates 51 to 54 has the through holes and recesses corresponding to the first communication channels 51*b* and the second communication channels 51*c*. The present disclosure, however, is not limited thereto. For example, two or more lower-side channel plates of the channel plates 51 to 54 may have the through holes and recesses corresponding to the first communication channels and the second communication channels.

In the above embodiment, the first communication channels 51*b* allow the first damper chambers 65 to communicate with each other, and the second communication channels 51*c* allow the first damper chambers 65 disposed at the most upstream side and the most downstream side in the conveyance direction to communicate with the atmosphere. The present disclosure, however, is not limited thereto. For example, no first damper chambers 65 may communicate with each other, and each first damper chamber 65 may communicate with the atmosphere individually.

In the above embodiment, second damper chambers may be provided separately from the first damper chambers 65 to hold the adhesive protruding from the joined surface between the damper 23 and the channel plate 51.

Figure 12:
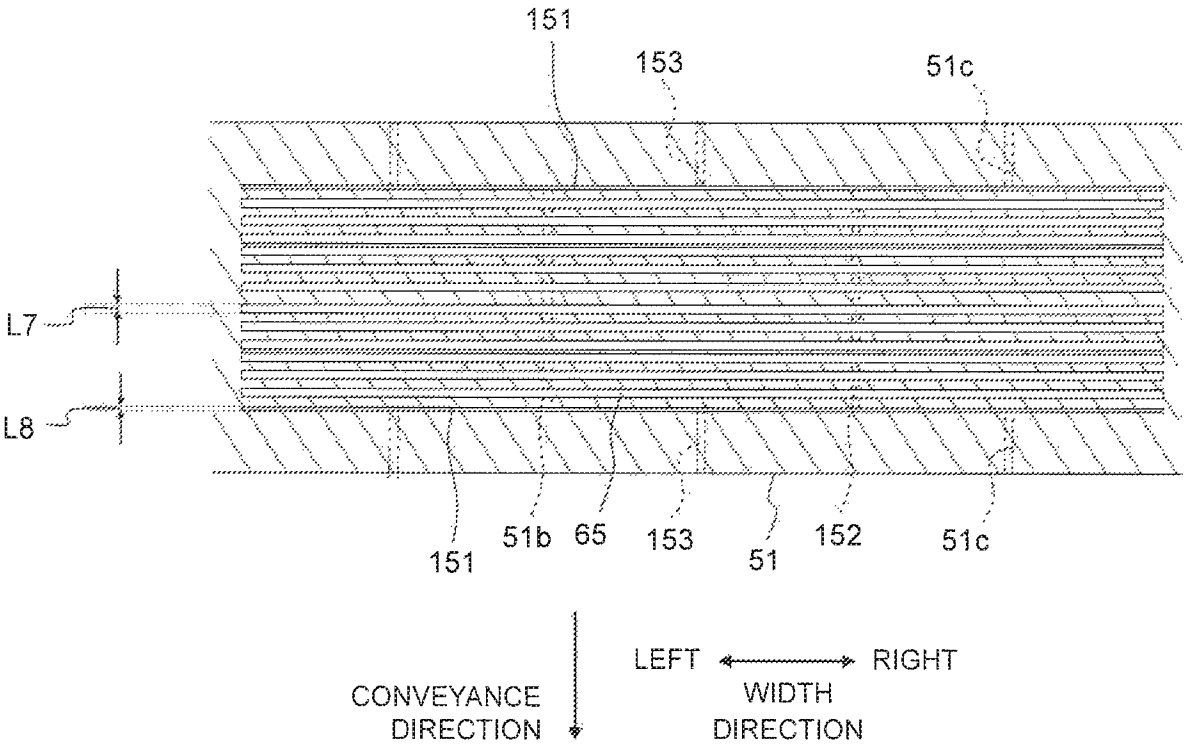
FIG. 12 depicts a first modified embodiment and corresponds to FIG. 8.

For example, in the first modified embodiment depicted in FIG. 12, second damper chambers 151 extending in the width direction are arranged in the channel plate 51 at a position upstream of the first damper chamber 65 that is disposed at the most upstream side in the conveyance direction and at a position downstream of the first damper chamber 65 that is disposed at the most downstream side in the conveyance direction. The second damper chambers 151 do not overlap with the manifolds 41 and 42 in the up-down direction. Further, a length L8 in the conveyance direction of the second damper chambers 151 is shorter than a length L7 in the conveyance direction of the first damper chambers 65. The length L7 is approximately the same as the length in the conveyance direction of the lower-side manifolds 41 and 42.

In the first modified embodiment, two first communication channels 152 extending in the conveyance direction allow the first damper chambers 65 and the two second damper chambers 151 to communicate with each other. Second communication channels 153 extending in the conveyance direction allow the second damper chambers 151 to communicate with the atmosphere.

In the configuration according to the first modified embodiment, the adhesive protruding from the joined surface between the damper 23 and the channel plate 51 is held by the second damper chamber(s) 151. The adhesive is thus not likely to flow into the first damper chamber(s) 65.

The volume of the second damper chambers 151 is not required to be so large provided that the second damper chambers 151 can hold the adhesive protruding from the joined surface. Thus, the channel plate 51 (connection channel unit 24) is prevented from having a large size in the conveyance direction by making the length L8 in the conveyance direction of the second damper chambers 151 shorter than the length L7 in the conveyance direction of the first damper chambers 65.

In the first modified embodiment, the length L8 in the conveyance direction of the second damper chambers 151 is shorter than the length L7 in the conveyance direction of the first damper chambers 65. The present disclosure, however, is not limited thereto. The length L8 may be not less than the length L7.

In the lower-side manifold plate 22 of the above embodiment, the length L2 of the partitioning wall 22*a*2 is longer than the length L1 of the partitioning wall 22*a*1. Corresponding to this, the length L4 of the second portion 23*b*2 of the damper 23 is longer than the length L3 of the second portion 23*b*1 of the damper 23. The present disclosure, however, is not limited thereto. For example, all the partitioning walls 22*a* of the lower-side manifold plate 22 may have the same length in the conveyance direction. Corresponding to this, all the second portions 23*b* of the damper 23 may have the same length in the conveyance direction.

In the above embodiment, the number of the upper-side return manifolds 92 is smaller than the number of the lower-side return manifolds 42, and the return connection channels 63 and 64 connect two lower-side return manifolds 42 and one upper-side return manifold 92. The present disclosure, however, is not limited thereto. The number of the upper-side return manifolds 92 may be the same as the number of the lower-side return manifolds 42, and the return connection channels may connect one lower-side return manifold 42 and one upper-side return manifold 92.

In the above embodiment, only the ends in the width direction of the lower-side supply manifolds 41 and the upper-side supply manifolds 91 are connected with each other, and only the ends in the width direction of the lower-side return manifolds 42 and the upper-side return manifolds 92 are connected with each other. The present disclosure, however, is not limited thereto.

Figure 13:
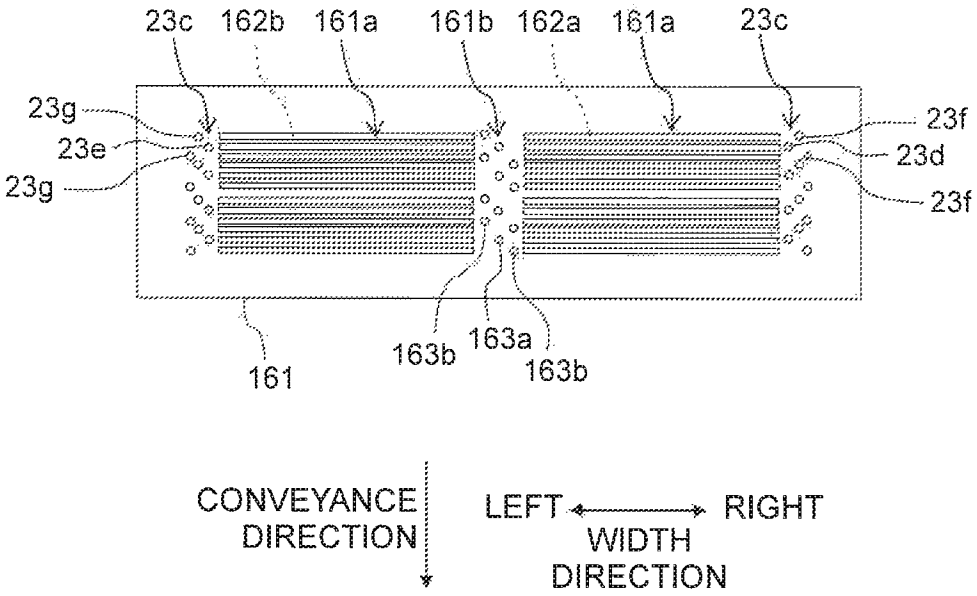
FIG. 13 depicts a second modified embodiment and corresponds to FIG. 6B.

In a second modified embodiment, as depicted in FIG. 13, through holes 162*a* are formed at portions included in a damper 161 (second damper member 47) and overlapping in the up-down direction with right portions in the width direction of the manifolds 41 and 42. Further, through holes 162*b* are formed at portions included in the damper 161 (second damper member 47) and overlapping in the up-down direction with left portions in the width direction of the manifolds 41 and 42. In that configuration, portions of the damper 161 having the through holes 162*a* and 162*b* correspond to first portions 161*a* that are formed by the second damper member 47.

An area of the damper 161 between the through holes 162*a* and 162*b* in the width direction is a third portion 161*b* (in which the first damper member 46 overlaps in the up-down direction with the second damper member 47) having no through holes. The damper 161 also has third portions 23*c* similar to those of the damper 23.

In the configuration of the second modified embodiment, two first portions 161*a* are arranged separated from each other in the width direction, and the third portion 161*b* is disposed between the two first portions 161*a* in the width direction.

The third portion 161*b* has four supply connection holes 163*a* and eight return connection holes 163*b*. The four supply connection holes 163*a* correspond to the four lower-side supply manifolds 41 (see FIG. 6A). Each supply connection hole 163*a* overlaps in the up-down direction with a center portion in the width direction of the corresponding lower-side supply manifold 41. The eight return connection holes 163*b* correspond to the eight lower-side return manifolds 42 (see FIG. 6A). Each return connection hole 163*b* overlaps in the up-down direction with a center portion in the width direction of the corresponding lower-side return manifold 42.

Although the detailed explanation is omitted, the connection channel unit 24 of the second modified embodiment includes, in addition to the configurations similar to the above embodiment, a channel connecting one supply connection hole 163*a* and a center portion in the width direction of one upper-side supply manifold 91 and a channel connecting the two supply connection holes 163*a* and a center portion in the width direction of the upper-side return manifold 92. Thus, in the second modified embodiment, the lower-side supply manifold 41 and the upper-side supply manifold 91 are connected to each other at three portions in the width direction (the left end, right end, and center portion in the width direction), and the lower-side return manifold 42 and the upper-side return manifold 92 are connected to each other at three portions in the width direction (the left end, right end, and center portion in the width direction). Further, in the connection channel unit 24, two first damper chambers are provided for each of the manifolds 41 and 42 such that they are arranged in the width direction at an interval.

In the second modified embodiment, the first portions 161*a* are arranged separately from each other in the width direction, the third portion 161*b* is provided between the first portions 161*a* in the width direction, and the third portion 161*b* has the supply connection holes 161*a* and the return connection holes 163*b*. This makes it possible to form the first portions for inhibiting the ink pressure fluctuation in the manifolds 41 and 42 and the channels communicating with the manifolds 41 and 42 without making the head unit large.

Further, the positional relationship in the damper between the first portions and the third portions having the supply connection holes and the return connection holes is not limited to those described in the above embodiment and the second modified embodiment. For example, the third portion having the supply connection holes and the return connection holes may be disposed only at a portion overlapping in the up-down direction with one end in the width direction of the manifolds 41 and 42. Or, the third portion having the supply connection holes and the return connection holes may be disposed only at a portion overlapping in the up-down direction with a center portion in the width direction of the manifolds 41 and 42.

In the above embodiment, the connection channels 61 and 62 connecting the lower-side supply manifolds 41 and the upper-side supply manifolds 91 and the connection channels 63 and 64 connecting the lower-side return manifolds 42 and the upper-side return manifolds 92 are formed in the connection channel unit 24 including the first damper chambers 65. The present disclosure, however, is not limited thereto. For example, a damper member, in which the first damper chambers 65 are formed and the connection channels 61 to 64 are not formed, may be provided instead of the connection channel unit 24, and the connection channels connecting the lower-side supply manifolds 41 and the upper-side supply manifolds 91 and the connection channels connecting the lower-side return manifolds 42 and the upper-side return manifolds 92 may be formed in another member.

In the above embodiment, the length in the up-down direction of the first damper member 46 is not more than 10 μm. The present disclosure, however, is not limited thereto. The length in the up-down direction of the first damper member 46 may exceed 10 μm. In that case, the first damper member 46 may be manufactured independently, and the damper 23 may be manufactured by joining the first damper member 46 to the second damper member 47 having the through holes 47*a*.

In the above embodiment, the inner wall surface of each through hole 47*a* in the second damper member 47 is the inclined surface 47*b* inclined to the up-down direction. The present disclosure, however, is not limited thereto. For example, the inner wall surfaces of each through hole 47*a* may be surfaces parallel to the up-down direction. For example, when the damper 23 is manufactured by joining the first damper member 46 to the second damper member 47, the through holes 47*a* having the inner wall surfaces parallel to the up-down direction may be formed in the second damper member 47 through any other method than etching, such as laser processing.

In the above embodiment, parts of lower surfaces of the second portions 23*b* overlapping in the up-down direction with the manifolds 41 and 42 may have grooves. In that case, the adhesive protruding from surfaces between the second portions 23*b* and the lower-side manifold plate 22 is held in the grooves, and thus the adhesive is less likely to reach the first portions 23*a*.

Here, the grooves in the second portions 23*b* are, for example, through holes passing through parts of the second damper member 47 corresponding to the second portions 23*b*, and upper surfaces of the grooves are formed by the first damper member 46. Or, the grooves in the second portions 23*b* are, for example, recesses formed in lower surfaces of the second damper member 47 corresponding to the second portions 23*b*. In order to allow the grooves to hold a large amount of adhesive to inhibit the adhesive from reaching the first portions 23*a*, the grooves are preferably the through holes.

In the above embodiment, parts of the lower surfaces of the second portions 23*b* overlapping in the up-down direction with the manifolds 41 and 42 may have walls extending downward. In that case, the walls block the flow of adhesive protruding from the surfaces between the second portions 23*b* and the lower-side manifold plate 22, and thus the adhesive is less likely to reach the first portions 23*a*.

In this example, for example, portions that are included in portions of the second damper member 47 corresponding to the second portions 23*b* and overlap in the up-down direction with the respective partitioning walls 22*a* have recesses of which length in the conveyance direction is longer than the length in the conveyance direction of the partitioning walls 22*a*. In that case, portions that are included in the portions of the second damper member 47 corresponding to the second portions 23*b* and are different from said portions are the walls extending downward. Or, another member corresponding to the walls may be joined to the lower surface of the second damper member 47.

In the above embodiment, the damper 23 is formed by disposing the film-like first damper member 46 on the upper surface of the second damper member 47 having the through holes 47*a*. The present disclosure, however, is not limited thereto.

Figure 14:
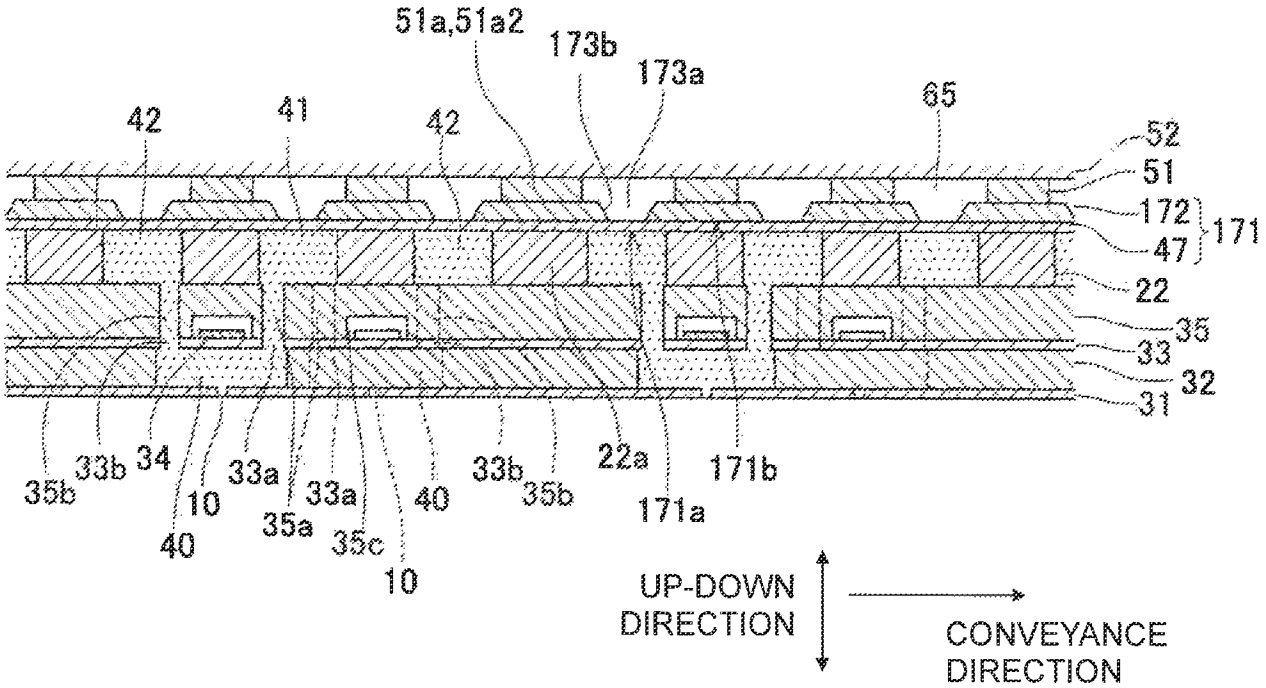
FIG. 14 depicts a third modified embodiment and corresponds to FIG. 5.

In a third modified embodiment depicted in FIG. 14, a damper 171 is formed by disposing the first damper member 46 similar to that of the above embodiment on a lower surface of a second damper member 172. The second damper member 172 has through holes 172*a* at portions that overlap in the up-down direction with portions of the manifolds 41 and 42 not including both ends in the conveyance direction. The length in the conveyance direction of the through hole 172*a* is shorter toward the lower side (toward the first damper member 46). In that case, each inner wall surface of the through hole 172*a* is an inclined surface 172*b* that is inclined to the up-down direction so that the lower side of the inclined surface 172*b* is closer to a center portion in the conveyance direction of the through hole 172*a* than the upper side. The positions of each through hole 172*a* in the width direction and the conveyance direction are similar to the positions of each through hole 47*a* in the above embodiment.

In the third modified embodiment, first portions 171*a* of the damper 171 where the first damper member 46 is exposed from the through holes 172*a* are elastically deformed to inhibit the pressure fluctuation in the manifolds 41 and 42. Second portions 171*b* that are included in portions of the damper 171 where the first damper member 46 overlaps in the up-down direction with the second damper member 172 and are joined to the partitioning walls 22*a* extend in the conveyance direction to positions overlapping in the up-down direction with the manifolds 41 and 42 and are connected to the first portions 171*a*.

Figure 15:
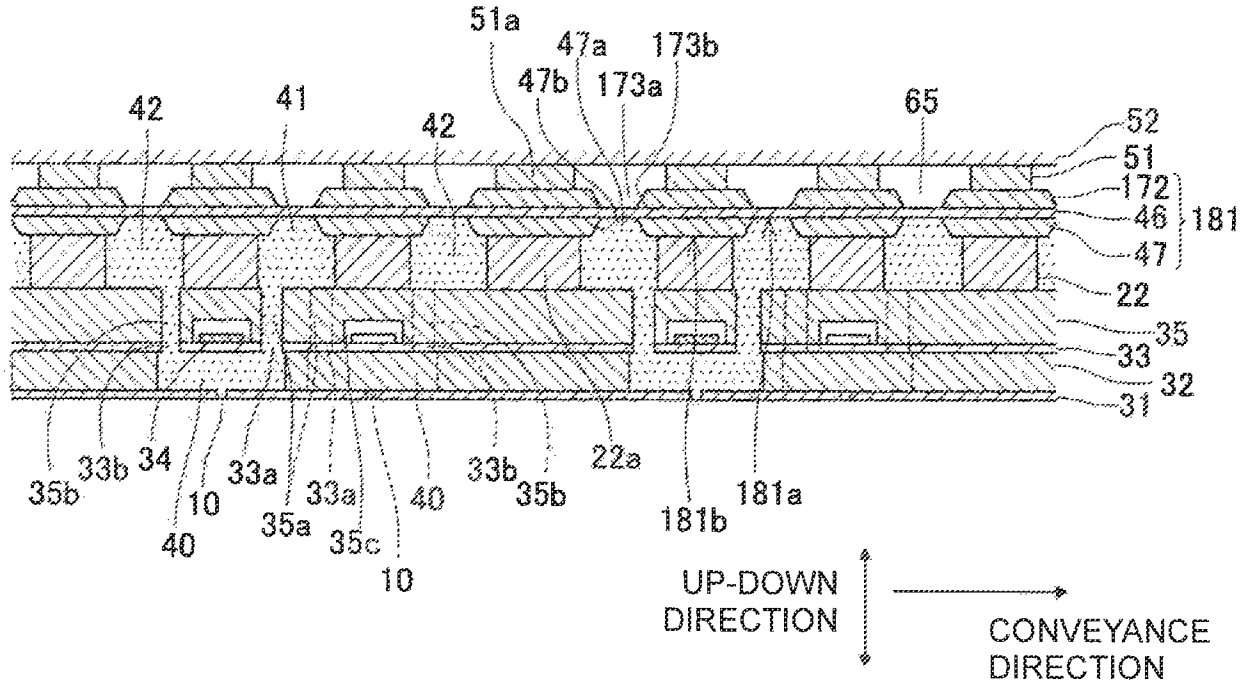
FIG. 15 depicts a fourth modified embodiment and corresponds to FIG. 5.

In a fourth modified embodiment depicted in FIG. 15, a damper 181 includes the first damper member 46 and the second damper member 47 similar to those of the damper 23 of the above embodiment as well as the second damper member 172 that is similar to that of the third modified embodiment and is disposed on the upper surface of the first damper member 46.

In the fourth modified embodiment, first portions 181*a* of the damper 181 where the first damper member 46 is exposed from the through holes 47*a* and 172*a* are elastically deformed to inhibit the pressure fluctuation in the manifolds 41 and 42. Second portions 181*b* that are included in portions of the damper 181 where the first damper member 46 overlaps in the up-down direction with the second damper member 47, 172 and that are joined to the partitioning walls 22*a* extend in the conveyance direction to positions overlapping in the up-down direction with the manifolds 41 and 42 and are connected to the first portions 181*a*.

Figure 16:
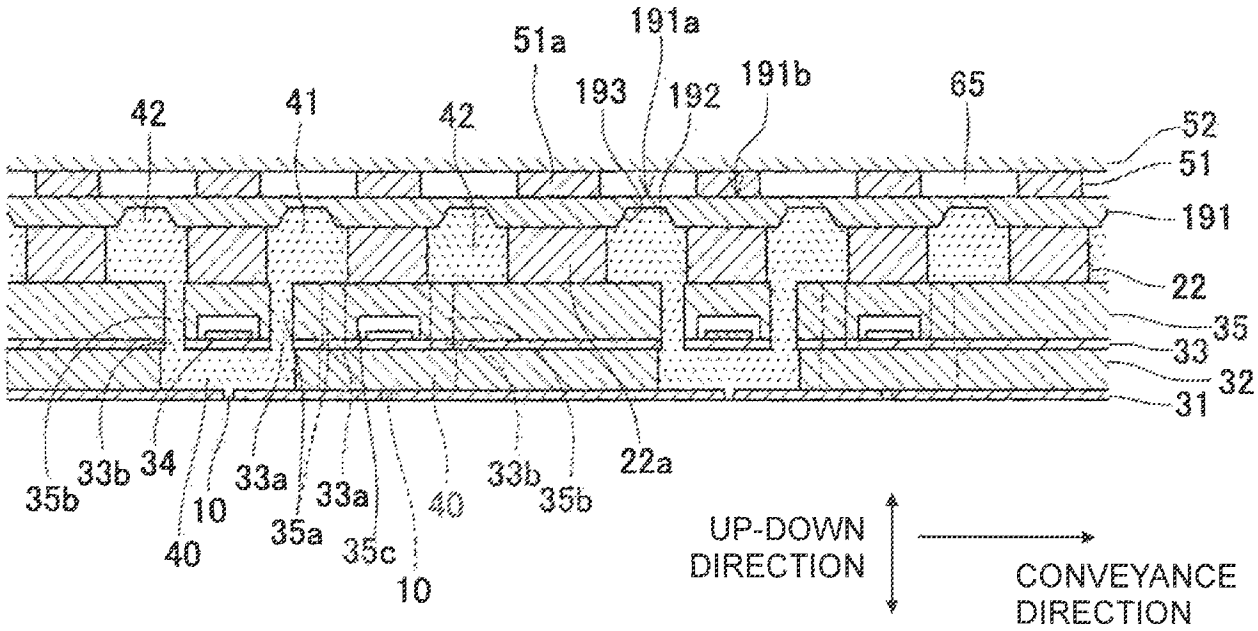
FIG. 16 depicts a fifth modified embodiment and corresponds to FIG. 5.

The damper may not be formed by stacking multiple members on top of each other. In a fifth modified embodiment depicted in FIG. 16, a damper 191 is formed by one member made by using, for example, a metal material. A lower surface of the damper 191 has recesses 192 at portions that overlap in the up-down direction with portions of the manifolds 41 and 42 not including both ends in the conveyance direction. In that case, each inner wall surface of the recess 192 is an inclined surface 192*a* that is inclined to the up-down direction so that the upper side of the inclined surface 192*a* is closer to a center portion in the conveyance direction of the recess 192 than the lower side. The recesses 192 can be formed, for example, by half etching. The positions of each recess 192 in the width direction and the conveyance direction are similar to those of the through hole 47*a* in the above embodiment.

In the fifth modified embodiment, first portions 191*a* of the damper 191 where the length in the up-down direction is shortened by forming the recesses 192 are elastically deformed to inhibit the pressure fluctuation in the manifolds 41 and 42. Second portions 191*b* that are included in portions of the damper 191 where no recesses 192 are not formed and that are joined to the partitioning walls 22*a* extend in the conveyance direction to positions overlapping in the up-down direction with the manifolds 41 and 42 and are connected to the first portions 191*a*.

In the fifth modified embodiment, the recesses 192 are formed in the lower surface of the damper 191. The present disclosure, however, is not limited thereto. Recesses may be formed in an upper surface of the damper 191 instead of the recesses 192. Alternatively, recesses may be formed in the upper surface of the damper 191 in addition to the recesses 192.

Also in the third to fifth modified embodiments, the adhesive protruding from the joined surface between the damper 191 and the lower-side manifold plate 22 and the adhesive protruding from the joined surface between the damper 191 and the connection channel unit 24 are not likely to reach the first portions. This allows the lower-side supply manifolds 41 and the lower-side return manifolds 42 to obtain the uniformity of effect for inhibiting the pressure fluctuation brought about by the damper.

In the above embodiment, the length L5 of the partitioning wall 51*a*1 and the length L6 of the partitioning wall 51*a*2 are shorter than the length L1 of the partitioning wall 22*a*1 and the length L2 of the partitioning wall 22*a*2, the partitioning wall 51*a*1 is positioned between the both ends in the conveyance direction of the partitioning wall 22*a*1, and the partitioning wall 51*a*2 is positioned between the both ends in the conveyance direction of the partitioning wall 22*a*2. The present disclosure, however, is not limited thereto. For example, the position of at least one end in the conveyance direction of the partitioning wall 22*a*1 may be the same as that of the partitioning wall 51*a*1, and the position of at least one end in the conveyance direction of the partitioning wall 22*a*2 may be the same as that of the partitioning wall 51*a*2. Or, the partitioning wall 22*a*1 may be positioned between both ends in the conveyance direction of the partitioning wall 51*a*1, and the partitioning wall 22*a*2 may be positioned between both ends in the conveyance direction of the partitioning wall 51*a*2.

The first damper chambers and the partitioning walls partitioning the first damper chambers may not be provided. For example, no member may be disposed on the upper surface of the damper and the damper may be exposed to the outside.

The ink flowing direction in the above embodiment and modified embodiments may be reversed. Namely, the channel used for returning ink from the pressure chamber 40 to the ink tank 110 in the above embodiment and modified embodiments may be used as the channel for supplying ink from the ink tank 110 to the pressure chamber 40. The channel used for supplying ink from the ink tank 110 to the pressure chamber 40 in the above embodiment and modified embodiments may be used as the channel for returning ink from the pressure chamber 40 to the ink tank 110.

In the above embodiment and modified embodiments, the present disclosure is applied to the ink-jet head configured to discharge ink from nozzles and the printer including the ink-jet head. The present disclosure, however, is not limited thereto. The present disclosure is applicable to a liquid discharge head configured to discharge any other liquid than ink from nozzles and a liquid discharge apparatus including the liquid discharge head.

What is claimed is:

1. A liquid discharge head, comprising:

an individual channel member including a plurality of individual channel rows, each of the individual channel rows including a plurality of individual channels arranged in a first direction, the individual channels including a plurality of nozzles respectively, the individual channel rows being arranged in a second direction intersecting with the first direction, a first common channel member stacked on the individual channel member in a third direction intersecting with the first direction and the second direction, the first common channel member including:

a plurality of first common channels provided for each of the individual channel rows, connected to the individual channels forming one of the individual channel rows corresponding thereto, and arranged in the second direction, and a first partitioning wall partitioning the first common channels adjacent to each other in the second direction, and a damper joined to the first common channel member with adhesive so that the first common channel member is disposed between the individual channel member and the damper in the third direction, wherein the damper has a plurality of first portions that are elastically deformable and overlap in the third direction with the first common channels and a second portion that is joined to the first partitioning wall, extends in the second direction to positions overlapping in the third direction with the first common channels, and is connected to the first portions, and the second portion is longer in the third direction than the first portions.

2. The liquid discharge head according to claim 1, further comprising a damper chamber member that includes: a plurality of damper chambers joined, with adhesive, to a surface of the damper on a side opposite to the first common channel member in the third direction and overlapping in the third direction with the first common channels; and a second partitioning wall partitioning the damper chambers adjacent to each other in the second direction, wherein the second portion is joined to the second partitioning wall and the second portion extends in the second direction to positions not overlapping in the third direction with the second partitioning wall.

3. The liquid discharge head according to claim 2, wherein the second partitioning wall is positioned between ends of the first partitioning wall in the second direction.

4. The liquid discharge head according to claim 1, wherein the damper includes a first damper member and a second damper member stacked in the third direction, a plurality of through holes is opened at portions of the second damper member overlapping in the third direction with a first common channel, each of the first portions is a portion of the first damper member overlapping in the third direction with the through holes, and the second portion is a portion, of the damper, overlapping the first damper member with the second damper member in the third direction.

5. The liquid discharge head according to claim 4, further comprising a damper chamber member that includes: a plurality of damper chambers joined, with adhesive, to a surface of the damper on a side opposite to the first common channel member in the third direction and overlapping in the third direction with the first common channels, wherein the first damper and the second damper include a plurality of connection holes arranged in the first direction and separated from each other, the plurality of connection holes being connected to the first common channels, and the damper chamber member includes a second connection channel connected to the connection holes.

6. The liquid discharge head according to claim 5, wherein each of the plurality of through hole of the second damper is positioned between the connection holes in the first direction.

7. The liquid discharge head according to claim 5, wherein the through hole of the second damper overlaps in the third direction with a plurality of portions of the first common channels separated from each other in the first direction, and the plurality of through hole of the second damper is arranged in the first direction.

8. The liquid discharge head according to claim 5, further comprising a second common channel member disposed on a side opposite to the damper with respect to the damper chamber member in the third direction and having a plurality of second common channels connected to the connection holes, the number of the plurality of second common channels is smaller than the number of the plurality of first common channels, and the second connection channel connects the first connection channel communicating with two or more of the first common channels and one of the second common channels.

9. The liquid discharge head according to claim 1, wherein the first partitioning wall includes a third partitioning wall and a fourth partitioning wall that is longer in the second direction than the third partitioning wall, the second portion includes a portion joined to the third partitioning wall and a portion joined to the fourth partitioning wall, and the portion joined to the third partitioning wall is longer in the second direction than the portion joined to the fourth partitioning wall.

10. The liquid discharge head according to claim 1, further comprising a damper chamber member that includes a plurality of first damper chambers joined, with adhesive, to a surface of the damper on a side opposite to the first common channel member in the third direction and overlapping in the third direction with the first common channels, wherein the damper chamber member includes a second damper chamber arranged adjacently to the first damper chambers in the second direction and not overlapping in the third direction with the first common channels.

11. The liquid discharge head according to claim 10, wherein the second damper chamber is shorter in the second direction than each of the first damper chambers.

12. The liquid discharge head according to claim 1, further comprising a damper chamber member that includes a plurality of damper chambers joined, with adhesive, to a surface of the damper on a side opposite to the first common channel member in the third direction and overlapping in the third direction with the first common channels, wherein the damper chamber member includes: a first communicating channel extending in the second direction and causing the damper chambers to communicate with each other; and a second communicating channel extending in the second direction, the second communicating channel being connected to one of the damper chambers disposed at a position closest to one side in the second direction and to an atmosphere.

13. The liquid discharge head according to claim 12, wherein the damper chamber member includes a plurality of plates stacked on top of each other in the third direction, and a plurality of through holes forming the first communicating channel and the second communicating channel are formed in one of the plates that is positioned closest to the damper in the third direction.

14. The liquid discharge head according to claim 12, wherein the damper chamber member includes a plurality of plates stacked on top of each other in the third direction, and a plurality of recesses forming the first communicating channel and the second communicating channel are formed at a part included in one of the plates closest to the damper in the third direction and positioned at a side of the damper.

15. The liquid discharge head according to claim 12, wherein a position of the first communicating channel in the first direction is different from a position of the second communicating channel in the first direction.

16. A liquid discharge head, comprising:

an individual channel member including a plurality of individual channels, a common channel member including a plurality of common channels connected to the individual channels and stacked on the individual channel member in a stacked direction, and a damper joined, with adhesive, to a surface of the common channel member on a side opposite to the individual channel member in the stacked direction, wherein the damper has a first damper member and a second damper member stacked on the first damper member in the stacked direction, the second damper member has a plurality of through holes at portions overlapping in the stacked direction with the common channels, and a diameter of the through holes is shorter toward the first damper member in the stacked direction.

17. The liquid discharge head according to claim 16, wherein a length in the stacked direction of the first damper member is not more than 10 μm.

* * * * *